US006848606B2

(12) United States Patent
Benoit et al.

(10) Patent No.: US 6,848,606 B2
(45) Date of Patent: Feb. 1, 2005

(54) APPARATUS FOR DISPENSING INDIVIDUAL PLASTIC FASTENERS FROM FASTENER STOCK

(75) Inventors: James C. Benoit, Needham, MA (US); Arnold R. Bone, deceased, late of Needham, MA (US); by Marilyn Bone Kloss, legal representative, Concord, MA (US); William G. Berrocal, Worcester, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/474,105

(22) PCT Filed: Apr. 4, 2001

(86) PCT No.: PCT/US01/10710

§ 371 (c)(1),
(2), (4) Date: Apr. 1, 2004

(87) PCT Pub. No.: WO02/081151

PCT Pub. Date: Oct. 17, 2002

(65) Prior Publication Data

US 2004/0159694 A1 Aug. 19, 2004

(51) Int. Cl.[7] ..... B25C 1/00
(52) U.S. Cl. ..... 227/67
(58) Field of Search ..... 227/67, 71, 97, 227/120, 136, 137

(56) References Cited

U.S. PATENT DOCUMENTS

| | | | | | |
|---|---|---|---|---|---|
| 4,288,017 | A | * | 9/1981 | Russell | 227/67 |
| 4,621,639 | A | * | 11/1986 | Transue et al. | 606/215 |
| 4,955,475 | A | * | 9/1990 | McCarthy et al. | 206/346 |
| 5,024,365 | A | * | 6/1991 | Bourque | 227/67 |
| 5,033,664 | A | * | 7/1991 | Bone et al. | 227/67 |
| 5,615,816 | A | * | 4/1997 | Deschenes et al. | 227/71 |

* cited by examiner

*Primary Examiner*—Scott A. Smith
(74) *Attorney, Agent, or Firm*—Kriegsman & Kriegsman

(57) ABSTRACT

An apparatus (11) for dispensing individual plastic fasteners from fastener stock (13), includes a housing (27) and a hollow slotted needle (173) mounted onto said housing (27). An indexing wheel (95) is rotatably disposed within the housing (27) and advances a fastener to the rear end of the needle (173). A rocker (177) is slidably disposed within the housing and serves to move the cross-bar of the fastener in parallel with the needle bore. A plunger (179) is disposed within the housing (27) and is capable of being slidably displaced by a trigger assembly. An ejector rod (181) is fixedly mounted onto the plunger (179) and serves to push the cross-bar of the fastener out of the front of the needle (173). An indexing slide (137) separate from the rocker (177) is slidably disposed within the housing (27) and serves to rotatably advance the indexing wheel (95) after the ejector rod (181) pushes the cross-bar of the fastener out the front end of the needle (173).

22 Claims, 21 Drawing Sheets

APPARATUS FOR DISPENSING INDIVIDUAL PLASTIC FASTENERS FROM FASTENER STOCK

BACKGROUND OF THE INVENTION

The present invention relates to an apparatus for dispensing individual plastic fasteners from fastener stock.

Plastic fasteners of the type having a cross-bar at one end, a paddle at the other end and a thin filament or cross-link connecting the two ends are well known in the art and are widely used in commerce to attach labels, price tags or other items to articles in a manner which minimizes the risk of inadvertent detachment therefrom. Typically, such plastic fasteners are manufactured in the form of a supply of fastener stock, the fastener stock being produced by molding or stamping from flexible plastic materials, such as nylon, polyethylene, and polypropylene.

In one well known type of fastener stock, the cross bar end of each fastener is connected to a runner bar to form a clip of fasteners. In another known type of fastener stock, often referred to simply as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define either a plurality of paddles or cross bars which are similarly joined together by short severable connectors.

The dispensing of individual fasteners from fastener stock is often accomplished with an apparatus commonly referred to as a tagger gun. Typically, a tagger gun is a hand held trigger operated device which is constructed to accept fastener stock. Tagger guns usually include a mechanism for feeding the cross bar end of a fastener into a hollow needle at the front end of the gun and a mechanism for pushing the cross bar end of the fastener that has been fed into the hollow needle out through the tip of the hollow needle. Some tagger guns are manually operated while other tagger guns are powered by an electric motor or a pneumatic device.

Tagger guns have been developed and are in use with both of the above described types of fastener stock.

For example, in U.S. Pat. No. 4,456,123 to D. B. Russell, which is incorporated herein by reference, there is disclosed an apparatus for dispensing fasteners which is manufactured and sold by AVERY DENNISON CORPORATION® of Pasadena, Calif. as the SYSTEM 1000® SWIFTACHER® Tool. The apparatus can be used to store, feed and dispense fastener stock of the type which includes a plurality of connected fasteners, each fastener comprising a flexible filament and a transversely disposed endear at one end, end-bars of adjacent fasteners being joined end-to-end by severable connectors at a portion of their peripheries. The apparatus comprises a hollow casing and a dispensing needle mounted to the casing, the needle having a longitudinal bore for slidably receiving the end-bar and a slot communicating with the longitudinal bore slidably receiving the filament. The apparatus also comprises means for advancing a fastener from a first position remote from the needle bore to a second position adjacent the rear end of the bore with the end-bar transversely disposed to the longitudinal axis of the bore, means for aligning the end-bar with the bore and means for dispensing the end-bar through the bore.

Although well known and widely used in commerce, tagger guns of the type described in U.S. Pat. No. 4,288,017 to D. B. Russell suffer from a few notable drawbacks.

As a first drawback, tagger guns of the type described in U.S. Pat. No. 4,288,017 to R. B. Russell include a single, spring activated slide which can cause jamming in the tagger gun upon partial compression of the trigger, which is highly undesirable. Specifically, the single, spring activated slide assists in both aligning the end-bar of a first fastener from the fastener stock into parallel alignment within the longitudinal axis of the needle and indexing a second successive fastener from the fastener stock so that its end-bar is positioned at the rear end of the needle at an angle with respect to the longitudinal axis of the needle. As a result, it has been found that, if the user fails to fully compress the tagger gun trigger, the slide will index the second fastener at the rear end of the needle before the first fastener is fully ejected from the hollow needle. Because the second fastener will be aligned within the hollow needle before completion the forward ejection stroke, a partial compression of the tagger gun trigger will result in both the first and second fasteners disposed within the hollow needle at the same time, thereby creating a serious risk of jamming, which is highly undesirable.

As a second drawback, tagger guns of the type described in U.S. Pat. No. 4,288,017 have a relatively large number of different components, many of which are spring loaded. Accordingly, it has been found that such tagger guns are relatively expensive, time-consuming and difficult to manufacture, which is highly undesirable.

As a third drawback, tagger guns of the type described in U.S. Pat. No. 4,288,017 utilize a fairly complicated process for advancing the fastener to the rear of the needle, rotating the end-bar of the fastener into alignment within the needle and ejecting the end-bar through the needle, thereby creating a rough and difficult trigger stroke, which is highly undesirable.

SUMMARY OF THE INVENTION

It is an object of the present invention to provide a new and improved apparatus for dispensing individual plastic fasteners from fastener stock.

It is another object of the present invention to provide an apparatus of the type described above which is less susceptible to jamming.

It is yet another object of the present invention to provide an apparatus of the type described above which has a limited number of parts and which is inexpensive to manufacture.

It is still another object of the present invention to provide an apparatus of the type described above which has a relatively smooth trigger stroke and a lower trigger activation force.

Accordingly, as one feature of the present invention, there is provided an apparatus for dispensing individual plastic fasteners from fastener stock, each fastener comprising a flexible filament and a transversely disposed cross-bar at one end, cross-bars of adjacent fasteners being joined end-to-end by severable connectors at a portion of their peripheries, said apparatus comprising a housing, a needle mounted onto said housing, said needle comprising a front end, a rear end and a longitudinal bore, an indexing wheel rotatably disposed within said housing, said indexing wheel rotatably advancing a fastener from the fastener stock to a first position at the rear end of said needle in which the cross-bar of the fastener is disposed at an angle relative to the bore, a rocker disposed within said housing for moving the cross-bar of the fastener from the first position to a second position at the rear end of said needle in which the cross-bar of the fastener is disposed in parallel with the bore, an ejector rod disposed within said housing for pushing the cross-bar of the fastener from the second position, through the bore and out the front end of said needle, and an indexing slide disposed within said housing for rotatably advancing said indexing wheel, said indexing slide being separate from said rocker.

As another feature of the present invention, there is provided an apparatus for dispensing individual plastic fasteners from fastener stock, each fastener comprising a flexible filament and a transversely disposed cross-bar at one end, cross-bars of adjacent fasteners being joined end-to-end by severable connectors, said apparatus comprising a housing, a needle mounted onto said housing, said needle comprising a front end, a rear end and a longitudinal bore, an indexing wheel rotatably disposed within said housing, said indexing wheel rotatably advancing a fastener from the fastener stock to a first position at the rear end of said needle in which the cross-bar of the fastener is disposed at an angle relative to the bore, said indexing wheel comprising a top surface, a bottom surface, a plurality of index pins formed onto the top surface and a handle formed onto the top surface, the bottom surface being shaped to include a plurality of grooves, a detent disposed into said housing, said detent comprising a tip which is sized and shaped to selectively engage the plurality of grooves formed in said indexing wheel, a rocker disposed within said housing for moving the cross-bar of the fastener from the first position to a second position at the rear end of said needle in which the cross-bar of the fastener is disposed in parallel with the bore, an ejector rod disposed within said housing for pushing the cross-bar of the fastener from the second position, through the bore and out the front end of said needle, and an indexing slide disposed within said housing for rotatably advancing said indexing wheel.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
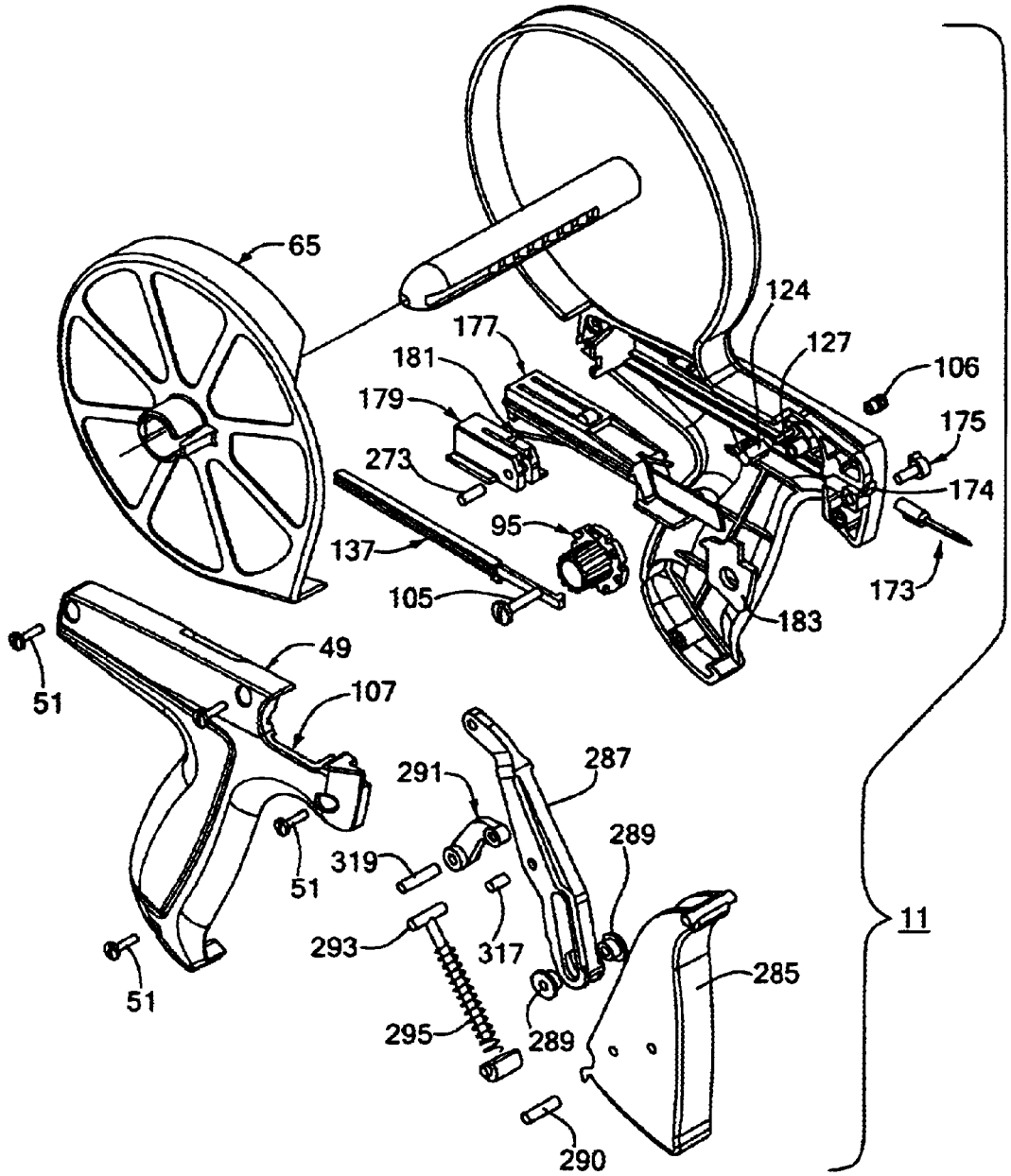
FIG. 1 is an exploded perspective view of an apparatus constructed according to the teachings of the present invention for dispensing individual plastic fasteners from fastener stock.
Figure 2:
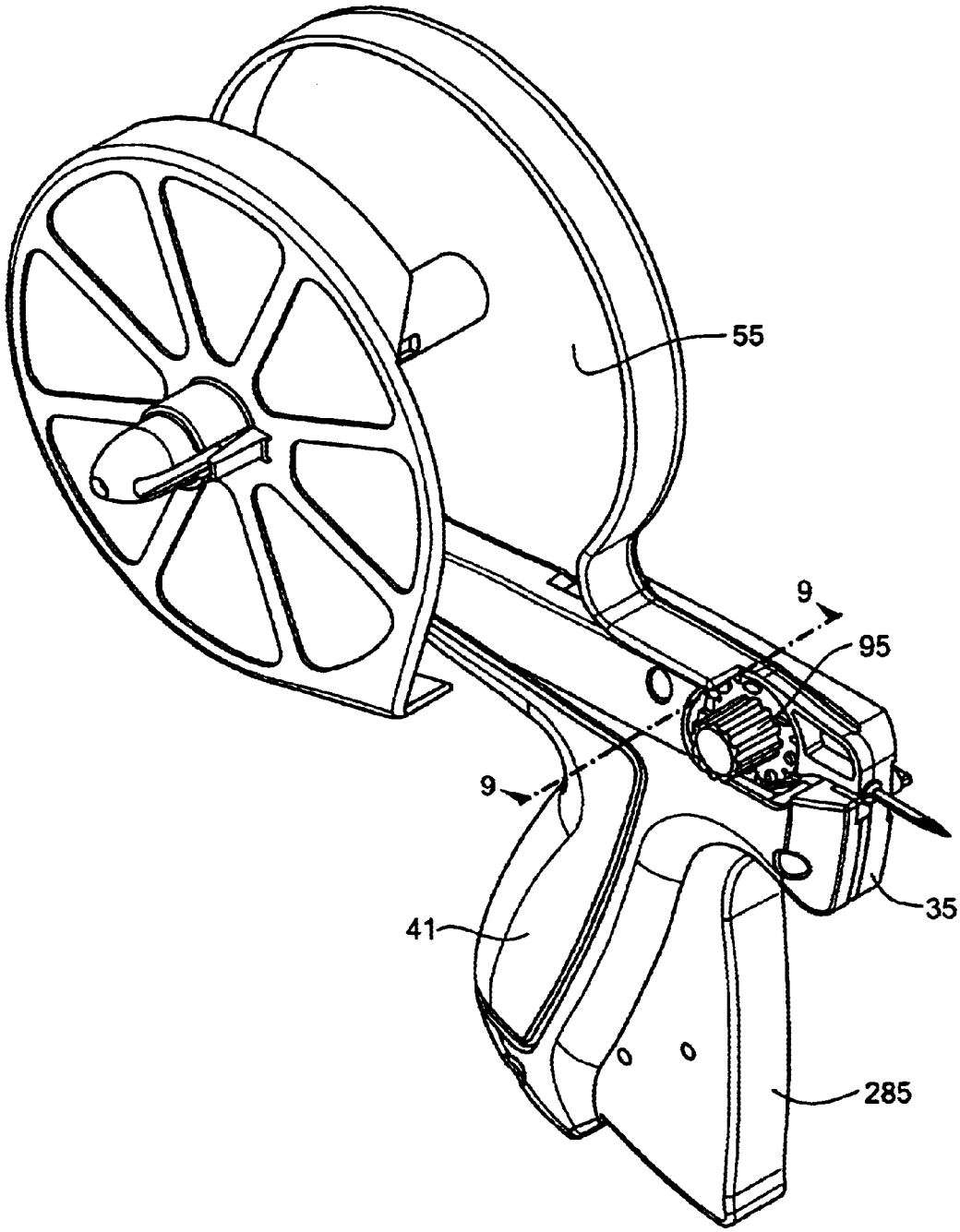
FIG. 2 is a perspective view of the apparatus shown in FIG. 1.

Referring now to FIGS. 1 and 2, there is shown an apparatus constructed according to the teachings of the present invention for dispensing individual plastic fasteners from fastener stock, the apparatus being identified generally by reference numeral 11.

Apparatus 11, also referred to herein as a tagger gun, can be used in conjunction with conventional rolls of fastener stock to attach labels, price tags or other items to articles of commerce using individual plastic fasteners. For example, tagger gun 11 can be used in conjunction with a supply of fastener stock 13 of the type described in U.S. Pat. No. 4,456,123 to Russell.

Figure 3:
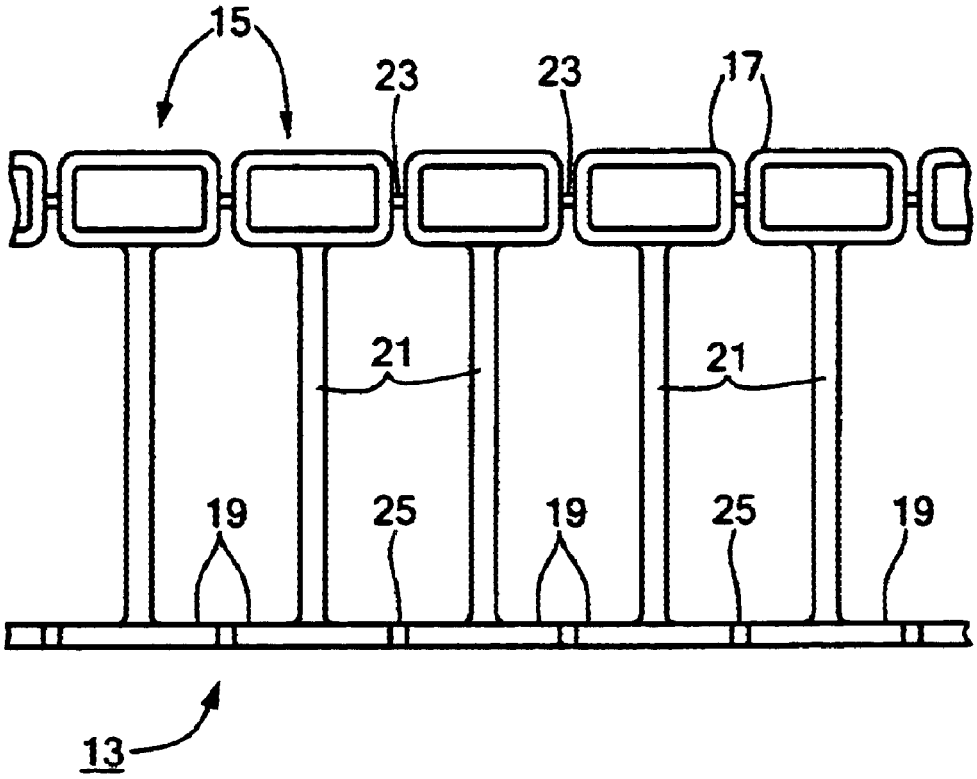
FIG. 3 PRIOR ART
FIG. 3 is a plan view of a prior art supply of fastener stock which can be used in conjunction with the apparatus shown in FIG. 1.

Specifically, referring now to FIG. 3, prior art supply of fastener stock 13 is constructed of a plastic material, such as nylon, polyethylene or polypropylene, and comprises a plurality of individual fasteners 15. Each fastener 15 comprises a first end 17 which is shaped to define a paddle or cross-bar, a second end 19 which is shaped to define a cross-bar, or T-bar, and a thin filament 21 which interconnects first end 17 to second end 19. First end 17 of successive fasteners 15 are joined together by severable connectors 23. Similarly, second end 19 of successive fasteners 15 are joined together by severable connectors 25. Fasteners 15 are disposed in a side-by-side relationship, thereby enabling supply of fastener stock 13 to be manufactured through a process of continuous molding. Typically, supply of fastener stock 13 is wound into a roll upon completion of manufacturing.

Tagger gun 11 comprises a housing 27, an indexing assembly 29 for indexing a desired fastener 15 from roll of fastener stock 13 within housing 27 for subsequent ejection, an ejection assembly 31 for dispensing the desired fastener 15 and a trigger assembly 33 coupled to ejection assembly 31.

Figure 4:
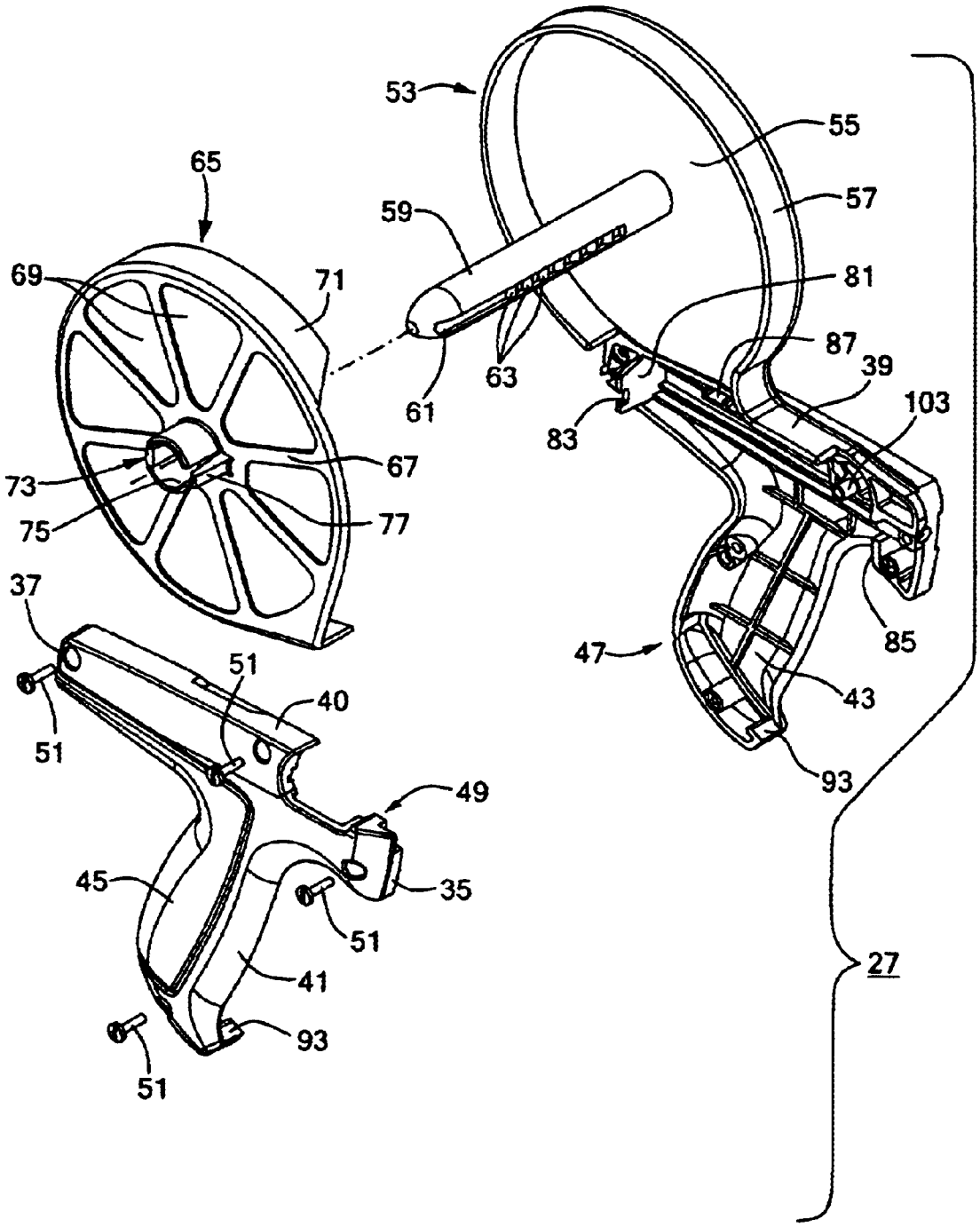
FIG. 4 is an exploded perspective view of the housing of the apparatus shown in FIG. 1.
Figure 5:
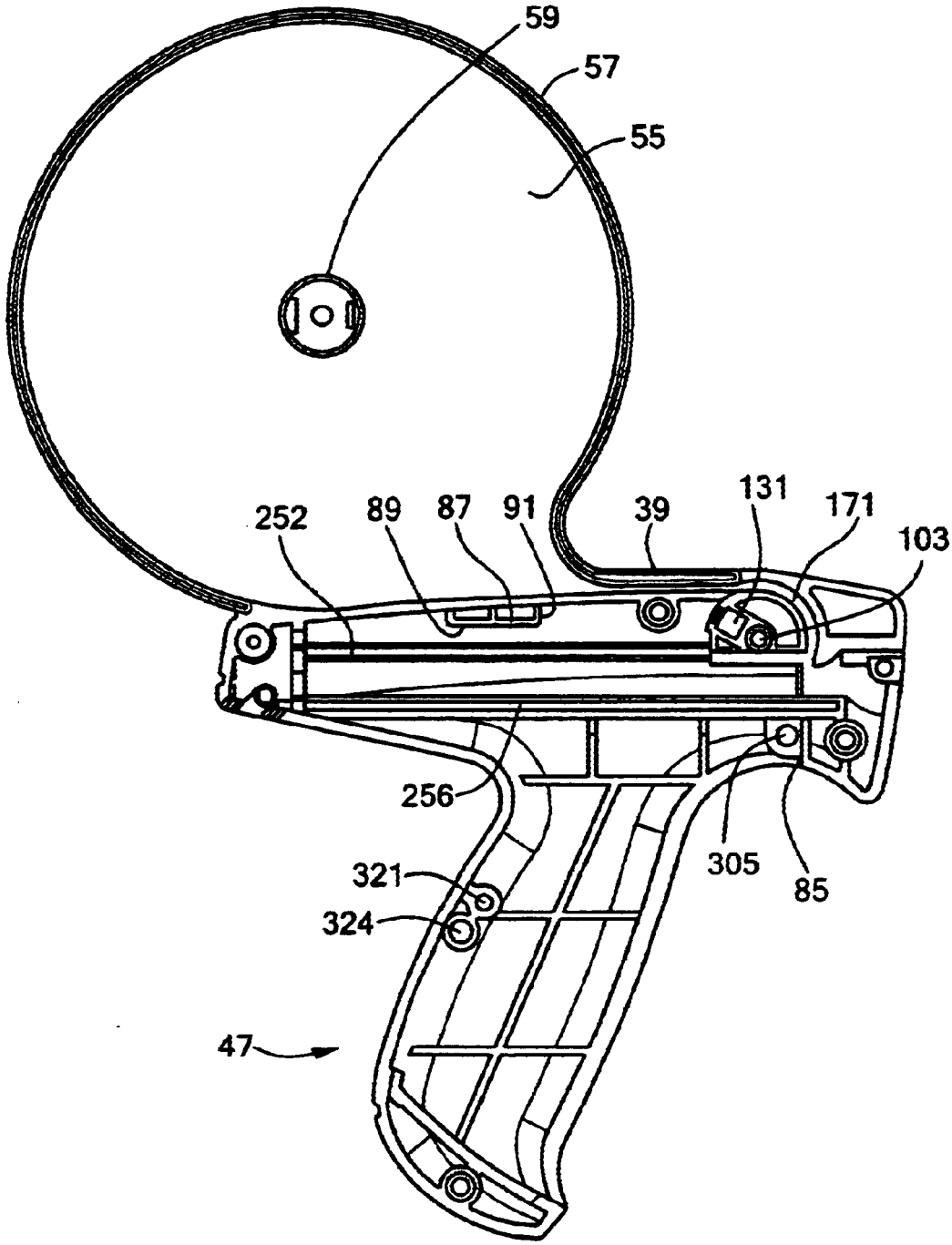
FIG. 5 is a right side view of the left side piece of the housing shown in FIG. 1.
Figure 6:
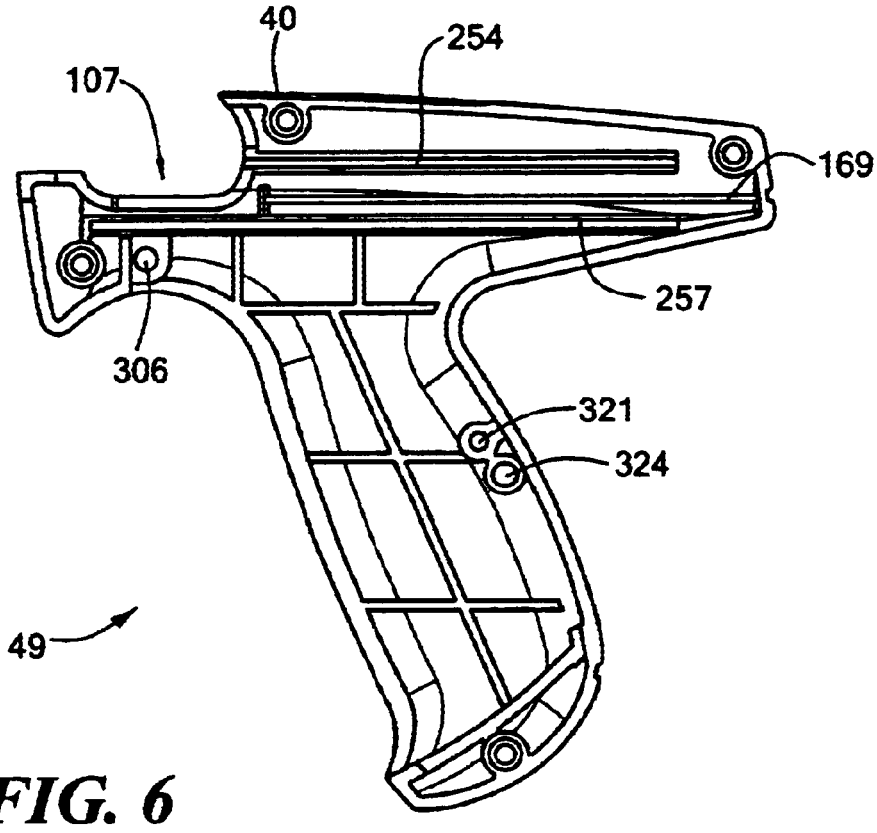
FIG. 6 is a left side view of the right side piece of the housing shown in FIG. 1.

Referring now to FIGS. 4–6, housing 27 is in the shape of a hollow gun and includes a front end 35, a rear end 37, a handle 41, an inner surface 43 and an outer surface 45. Housing 27 is preferably constructed of a rigid and durable material such as polycarbonate.

Housing 27 includes a left side piece 47 having a top surface 39 and a right side piece 49 having a top surface 40, left side piece 47 and right side piece 49 being affixed together by a plurality of screws 51. It should be noted that left side piece 47 and right side piece 49 are not limited to being affixed together by screws 51. Rather, it is be understood that left side piece 47 and right side piece 49 may be joined together by alternative means, such as through a snap-fit, sonic welding, gluing, riveting or the like, without departing from the spirit of the present invention.

Housing 27 also includes an attachment 53 for holding a roll of fastener stock. Attachment 53 for holding supply of fastener stock 13 includes a generally circular, vertical extension 55 which is integrally formed onto left side piece 47. A sidewall 57 is integrally formed onto and extends perpendicularly out from the majority of the outer periphery of vertical extension 55. A generally cylindrical projecting rod 59 is integrally formed onto and projects perpendicularly out from the approximate midpoint of vertical extension 55. Projecting rod 59 includes an elongated channel 61 formed along its length and a plurality of ratchet teeth 63 disposed within channel 61.

A cover 65 is sized and shaped to be slidably and lockably mounted onto projecting rod 59 to secure supply of fastener stock 13 onto attachment 53. Cover 65 comprises a circular end panel 67 which is preferably transparent to enable the user to monitor the supply of fastener stock 13. A sidewall 71 is integrally formed onto and extends perpendicularly out from the majority of the outer periphery of end panel 67. A central boss 73 is integrally formed onto end panel 67, boss 73 defining an opening 75 therewithin which is sized and shaped to receive projecting rod 59. A pivotally mounted locking pawl 77 is disposed to project into opening 75 and is adapted to releasably engage ratchet teeth 63 formed on projecting rod 59. It should be noted that locking pawl 77 is of a sufficient length to enable a user to easily disengage locking pawl 77 from ratchet teeth 63 by hand in order to remove cover 65 from projecting rod 59.

As can be appreciated, attachment 53 is constructed to hold a supply of spirally wound fastener stock 13. Specifically, supply of spirally wound fastener stock 13 may be secured onto projecting rod 59 and slid against vertical extension 55 with supply of fastener stock 13 entirely disposed within circular sidewall 57. With supply of fastener stock 13 mounted onto projecting rod 59 in this manner, cover 65 is slidably mounted onto projecting rod 59 and is advanced towards vertical extension 55. As cover 65 is advanced towards vertical extension 55, pawl 77 engages ratchet teeth 63 so as to prevent cover 65 from inadvertently being slid away from vertical extension 55. As such, extension 55 and cover 65 sandwich supply of fastener stock 13 therebetween, thereby securing fastener stock 13 onto attachment 53.

Figure 7:
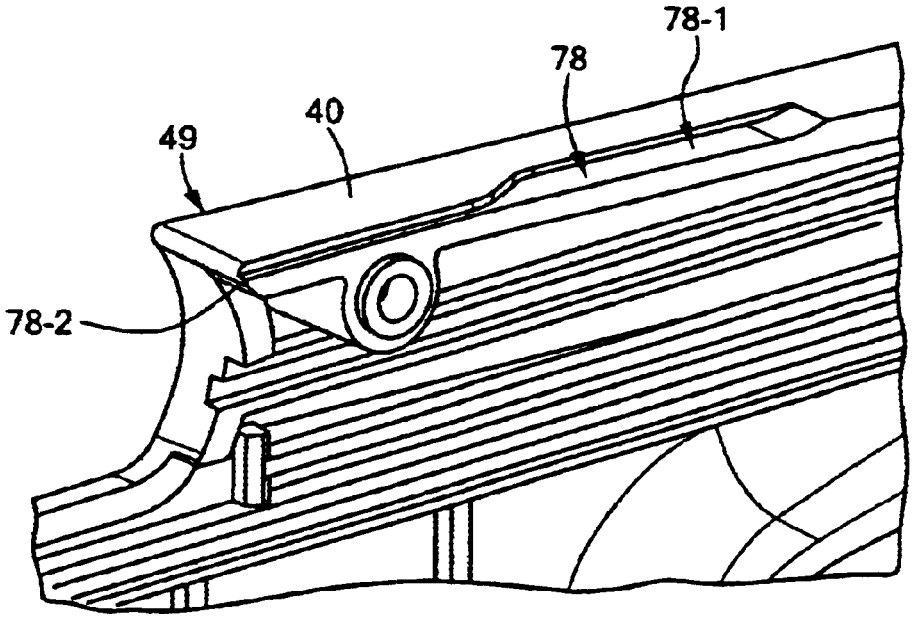
FIG. 7 is an enlarged, fragmentary, perspective view of the right side piece of the housing shown in FIG. 6.
Figure 8:
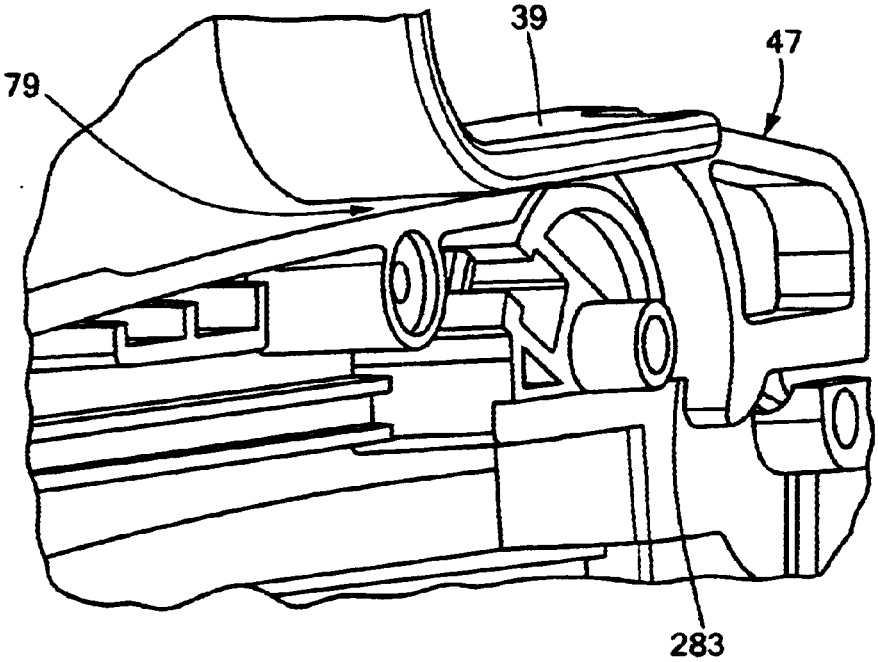
FIG. 8 is an enlarged, fragmentary, perspective view of the left side piece of the housing shown in FIG. 5.
Figure 9:
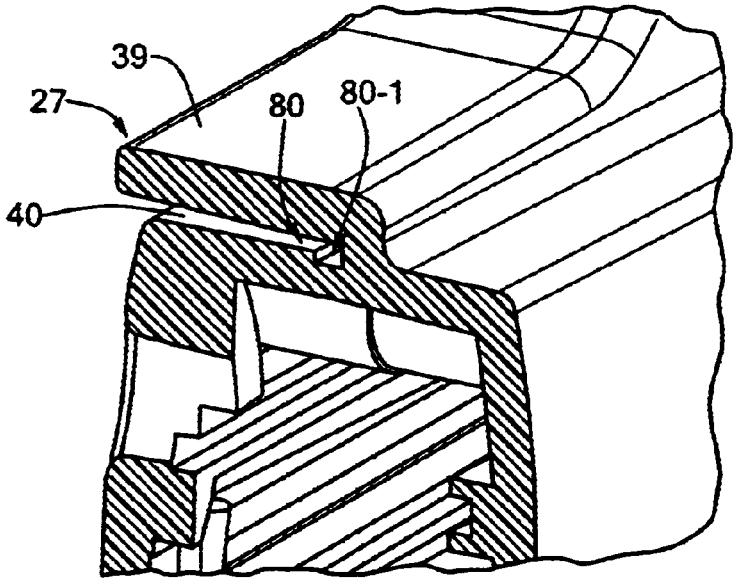
FIG. 9 is an enlarged, fragmentary, section, perspective view of the housing shown in FIG. 2, taken along lines 9—9.

A narrow fastener passageway 78 is formed into right side piece 49 of housing 27, as shown in FIG. 7. Fastener passageway 78 includes an entry end 78-1 formed into top surface 40 and an exit end 78-2 formed directly beneath top surface 40. Similarly, a narrow fastener passageway 79 is formed beneath top surface 39 of left side piece 47 of housing 27, as shown in FIG. 8. Accordingly, with left side piece 47 and right side piece 49 affixed together, passageway 78 and passageway 79 together define a fastener track 80 which is sized and shaped to receive the supply of fastener stock 13, as shown in FIG. 9.

It should be noted that track 80 includes a cross-bar portion 80-1 which is sized and shaped to securely retain second end 19 of fasteners 15 therewithin, thereby preventing the supply of fastener stock 13 from being inadvertently removed from apparatus 11, which is highly desirable. In this manner, track 80 serves to guide the supply of fastener stock 13 from attachment 53 and into indexing assembly 29. At that point, the user can manually operate indexing assembly 29, as will be described further in detail below, in order to advance the supply of fastener stock 13 down into ejection assembly 31.

A rear rocker stop 81 is integrally formed onto left side piece 47 of housing 27 and extends perpendicularly out from left side piece 47 towards right side piece 49. Rear rocker stop 81 is shaped to include a slot 83 and serves as an abutment surface for limiting rearward displacement of ejection assembly 31 during use, as will be described further in detail below.

A forward rocker stop 85 is integrally formed into housing 27 and extends perpendicularly between left side piece 47 and right side piece 49. Forward rocker stop 85 serves as an abutment surface for limiting forward displacement of ejection assembly 31 during use, as will be described further in detail below.

An intermediate rocker stop 87 is integrally formed onto left side piece 47. Intermediate rocket stop 87 extends horizontally beneath inner surface 43 of top surface 39 of left side piece 47 so as to form a horizontal bottom surface 89 and a vertical front edge 91. Intermediate rocker stop 87 serves as an abutment surface for limiting rearward displacement of ejection assembly 31 during use, as will be described further in detail below.

A trigger stop 93 is integrally formed onto handle 41 of housing 27 and serves to limit the outward displacement of trigger assembly 33, as will be described further in detail below.

Figure 10:
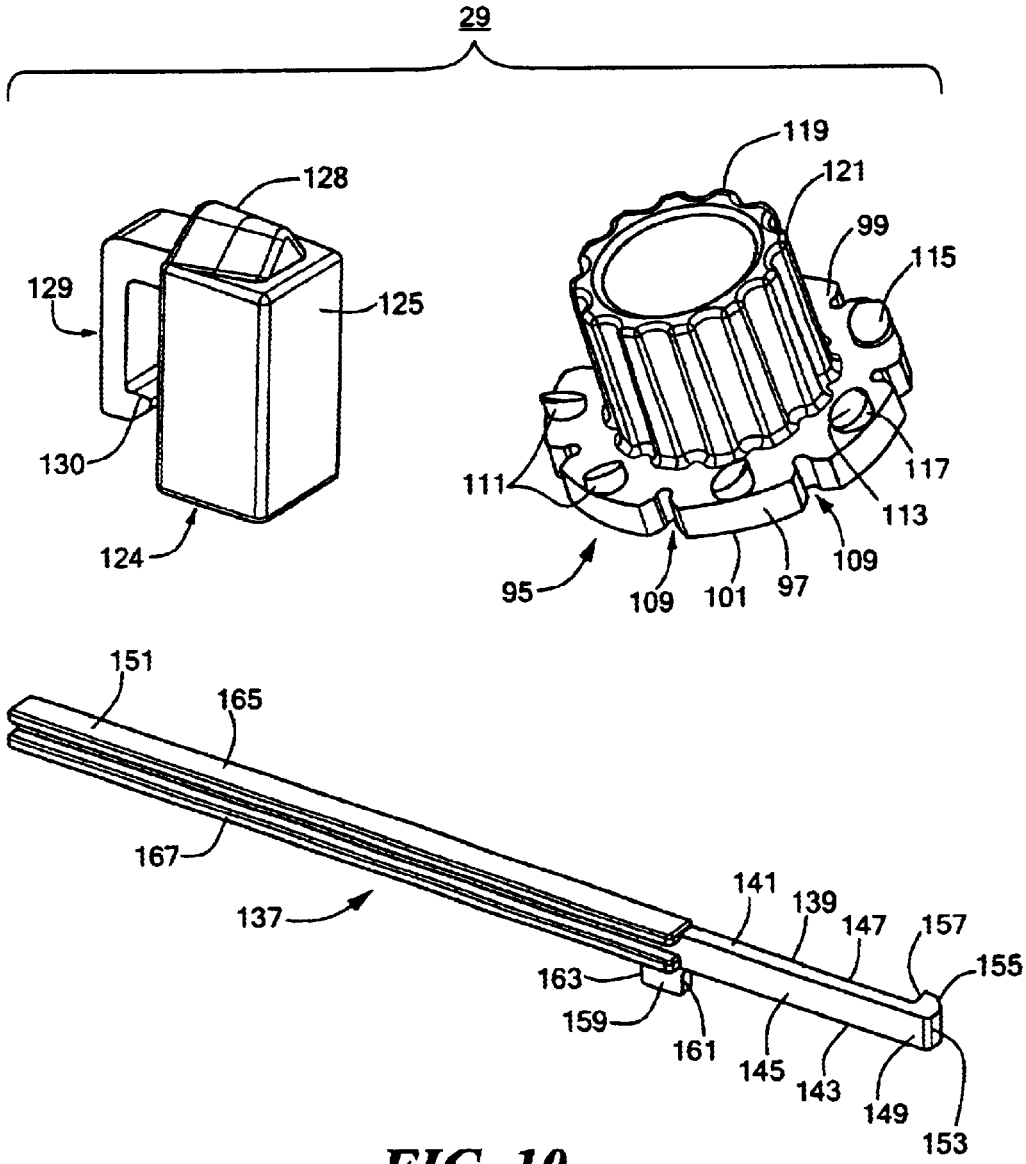
FIG. 10 is an enlarged, exploded, perspective view of the indexing assembly shown in FIG. 1.

Referring now to FIG. 10, indexing assembly 29 serves to index a desired fastener 15 from fastener stock 13 into proper alignment within housing 27 for subsequent ejection. Specifically, indexing assembly 29 is in communication with fastener track 80 and serves to feed individual fasteners 15 from attachment 53 down to ejection assembly 31 for subsequent ejection.

Indexing assembly 29 comprises an indexing wheel 95 which is rotatably mounted onto left side piece 47 of housing 27 proximate front end 35.

Indexing wheel 95 comprises a generally circular disk 97 having a top surface 99, a bottom surface 101 and a central opening 102 formed therein. Indexing wheel 95 is mounted onto an indexing wheel post 103 which is integrally formed onto left side piece 47 of housing 27, post 103 comprising a longitudinal central bore 104. Specifically, indexing wheel 95 is mounted onto left side piece 47 of housing 27 so that indexing wheel post 103 projects through central opening 102 in indexing wheel 95. Indexing wheel 95 is secured onto indexing wheel post 103 by an indexing wheel screw 105 which is disposed through central opening 102 and down into threaded engagement with a threaded insert 106 which is disposed within bore 104 of post 103.

It should be noted that right side piece 49 of housing 27 is shaped to include a cut-out portion 107 proximate front end 35, cut-out portion 107 being sized and shaped to render the majority of indexing wheel 95 uncovered by right side piece 49 when tagger gun 11 is in its assembled form, as shown in FIG. 2. As a result, in the case that an individual plastic fastener 15 becomes jammed within indexing assembly 29, the user can unscrew screw 105, remove indexing wheel 95, and manually discard jammed fastener 15 without separating left side piece 47 from right side piece 49, which is highly desirable.

A plurality of notches 109 are formed along the outer periphery of disk 97, each notch 109 being sized and shaped to receive filament 21 of a fastener 15. Plurality of notches 109 are spaced about the outer periphery of disk 97 equal to the spacing between successive fastener filaments 21 in fastener stock 13.

A plurality of index pins 111 are formed onto top surface 99 of disk 97 along its outer periphery. As will be described further in detail below, plurality of pins 111 are generally circular in lateral cross-section and are spaced about disk 97 equal to the spacing between successive fastener filaments 21 in fastener stock 13.

Each pin 111 comprises an substantially flat top surface 113. Top surface 113 is angled so as to form a front wall 115 which lies nearly flush with top surface 99 and a rear wall 117. Rear wall 117 extends perpendicularly out from top surface 99 and serves as an engagement surface, as will be described further in detail below.

A handle 119 is integrally formed onto top surface 99 of disk 97. Handle 119 is generally cylindrical and has a roughened exterior surface 121 to facilitate grasping handle 119 during manual rotation of indexing wheel 95.

A plurality of V-shaped grooves 123 are formed into bottom surface 101 of disk 97 and are sized and shaped to be selectively engaged by a spring biased detent 124.

Specifically, referring to FIGS. 10 and 12–14, detent 124 comprises a generally rectangular body, or block, 125 which includes a longitudinal, elongated bore 126, bore 126 being sized and shaped to receive a compression spring 127. Detent 124 also comprises a V-shaped tip 128 which is integrally formed onto body 125. Detent 124 further comprises a pivotable catch arm 129 which is integrally formed onto body 125, catch arm 129 including a finger 130.

Figure 13:
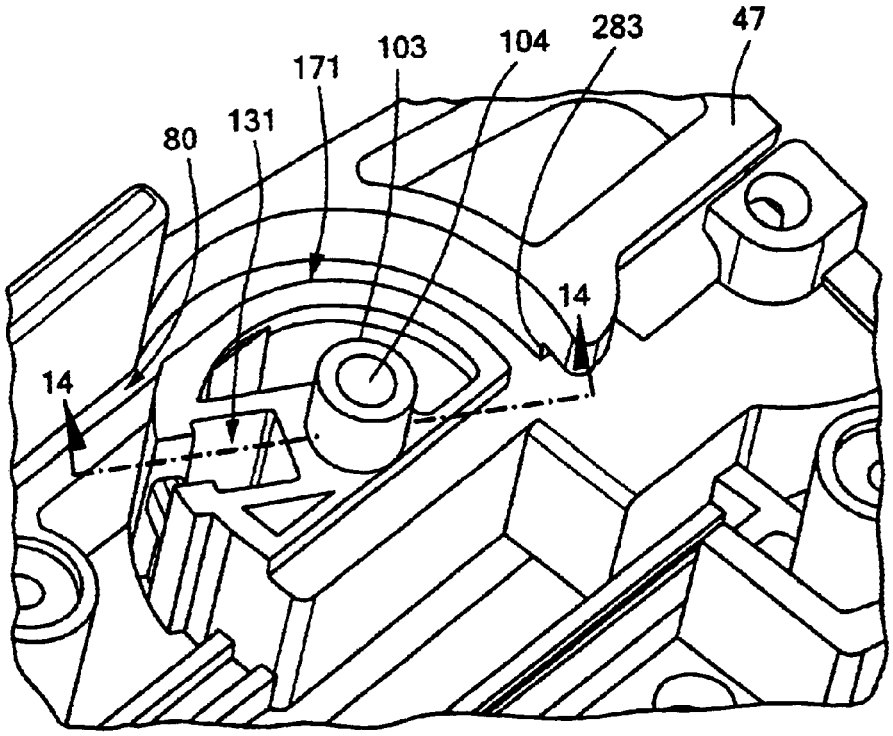
FIG. 13 is an enlarged, fragmentary, perspective view of the left side piece of the housing shown in FIG. 8.
Figure 14:
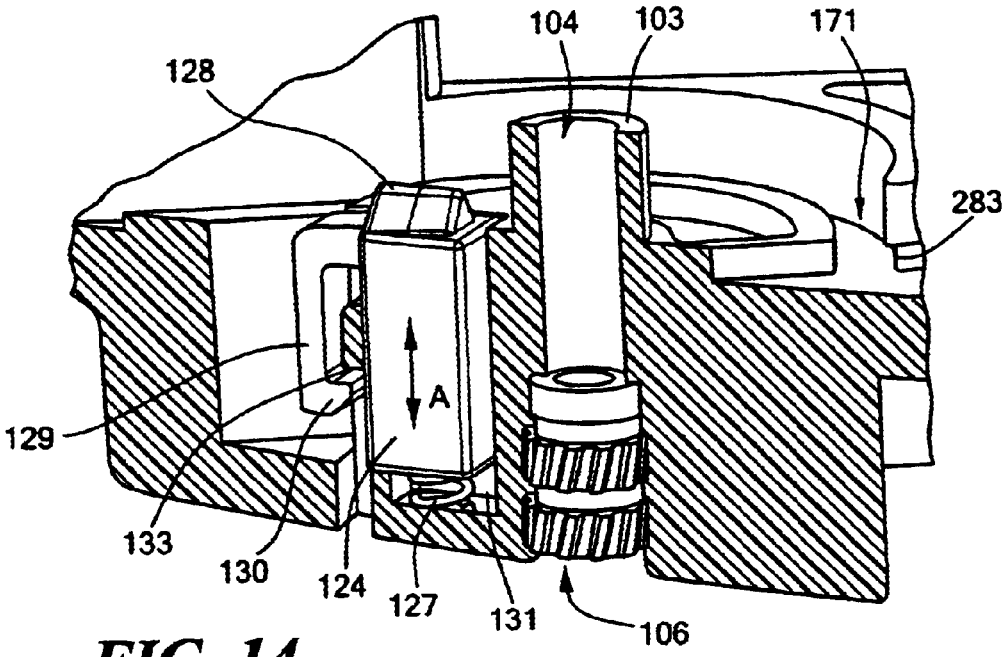
FIG. 14 is an enlarged, fragmentary, section, perspective view of the left side piece of the housing shown in FIG. 13, taken along lines 14—14, the left side piece of the housing being shown with the detent, compression spring and insert mounted thereon.

As can be appreciated, detent 124 is sized and shaped to snap-fit into a detent receptacle 131 which is formed in left side piece 47 proximate indexing wheel post 103, as shown in FIG. 13. Specifically, detent 124 can be snap-fit into detent receptacle 131 so that finger 130 is disposed beneath an undercut 133 formed in left side piece 47, as shown in FIG. 14, thereby preventing detent 124 from inadvertently falling out of detent receptacle 131. With detent 124 disposed within detent receptacle 131 as such, compression spring 127 enables detent 124 to move vertically within receptacle 131, as represented by arrows A in FIG. 14.

As can be appreciated, with detent 124 positioned within detent receptacle 131 so that tip 128 projects away from left side piece 47, indexing wheel 95 is mounted onto left side piece 47 over detent 124. In this manner, detent 124 is capable of being inwardly displaced as indexing wheel 95 rotates. However, with detent 124 aligned directly beneath a groove 123 in disk 95, once indexing wheel 95 terminates rotation, spring 127 biases detent 124 outward so that tip 128 projects into a groove 123, thereby locking indexing wheel 95 in a fixed position until further rotation, which is highly desirable.

It should be noted that the particular construction of detent 124 and indexing wheel 95 as well as the placement of detent 124 beneath indexing wheel 95 provides three principal advantages.

As a first advantage, the ability to snap-fit detent 124 within detent receptacle 131 considerably facilitates the assembly of apparatus 11, which is highly desirable.

As a second advantage, the ability to retain detent 124 within receptacle 131 through the use of finger 130 and undercut 133 considerably facilitates assembly of apparatus 11. Specifically, the locking arrangement between finger 130 and undercut 133 serves to lock detent 124 in place within left side piece 47 during assembly, which is highly desirable.

As a third advantage, the particular engagement between detent 124 and indexing wheel 95 is significant in that indexing wheel 95 is capable of rotation in either direction, thereby facilitating the elimination of a jamming condition within apparatus 11, which is highly desirable. Specifically, the particular engagement between detent 124 and indexing wheel 95 enables indexing wheel 95 to be manually rotated in the counterclockwise direction to remove loaded fasteners.

Referring now to FIG. 10, indexing slide 137 functions to selectively engage posts 111 so as to rotate indexing wheel 95 in a clockwise direction. Indexing slide 137 comprises an elongated arm 139 having a top surface 141, a bottom surface 143, a front surface 145, a back surface 147, a first end 149 and a second end 151.

A ratchet tooth 153 is integrally formed onto back surface 147 of arm 139 at first end 149. Ratchet tooth 153 includes a sliding surface 155 which is angled, or ramped, away from first end 149 of arm 139. Ratchet tooth 153 also includes an engagement surface 157 which is substantially flat and extends generally perpendicularly away from back surface 147 of arm 139.

A tab 159 is integrally formed onto bottom surface 143 of arm 139 between first end 149 and second end 151, tab 159 extending perpendicularly away from bottom surface 143. Tab 159 is generally rectangular and includes a forward edge 161 and a rearward edge 163.

An upper guide wall 165 is integrally formed onto top surface 141 of arm 139 and extends perpendicularly away from front surface 145. Similarly, a lower guide wall 167 is integrally formed onto bottom surface 143 of arm 139 and extends perpendicularly away from front surface 145. Upper guide wall 165 and lower guide wall 167 both extend from second end 151 of arm 139 to forward edge 161 of tab 159.

It should be noted that upper guide wall 165 and lower guide wall 167 are spaced apart. As a result, an elongated slide projection 169 which is integrally formed onto inner surface 43 of right side piece 49 protrudes between upper guide wall 165 and lower guide wall 167 when tagger gun 11 is in its assembled form, thereby limiting indexing slide 137 to horizontal displacement only, which is highly desirable. It should also be noted that indexing slide 137 is sized and shaped so that second end 151 lies within slot 83 formed in rear rocker stop 81 when tagger gun 11 is in its assembled form, thereby further limiting indexing slide 137 to horizontal displacement only.

As will be described further below, indexing assembly 29 functions in the following manner. The free end of supply of fastener stock 13 is fed from attachment 53, through track 80 and down onto the outer periphery of indexing wheel 95. Each notch 109 formed into the outer periphery of indexing wheel 95 is sized and shaped to receive a fastener filament 21. Rotation of indexing wheel 95 advances fasteners 15 in an arcuate path about wheel 95 and disposes the lowermost fastener 15 to a position adjacent the rear end of a forwardly projecting needle in ejection assembly 31. As can be appreciated, an arcuate T-bar passageway 171 is formed onto inner surface 43 of left side piece 47 around indexing wheel post 103, passageway 171 being in communication with track 80. Accordingly, as indexing wheel 95 rotates, second end 19 of fasteners 15 arcuately travel along passageway 171.

Indexing wheel 95 is rotated in the clockwise direction by indexing slide 137, detent 124 temporarily locking indexing wheel 95 in place after rotation. Preferably, indexing slide 137 rotates indexing wheel 95 clockwise one position. It should be noted that horizontal displacement of indexing slide 137 rotates indexing wheel 95. Specifically, forward displacement of indexing slide 137 enables angled sliding surface 155 of tooth 153 to ride up and over angled top surface 113 of the lowermost index pin 111 on indexing wheel 95. With tooth 153 of indexing slide 137 disposed in front of the lowermost indexing pin 111, subsequent rearward displacement of indexing slide 137 causes engagement surface 157 of tooth 153 to contact engagement surface 117 of the lowermost pin 111 and rotate indexing wheel 95 clockwise one position so that the next fastener 15 in supply of fastener stock 13 is fed into position with second end 19 disposed at an angle relative to the longitudinal axis of the needle bore for subsequent ejection, as will be described further in detail below.

Figure 11:
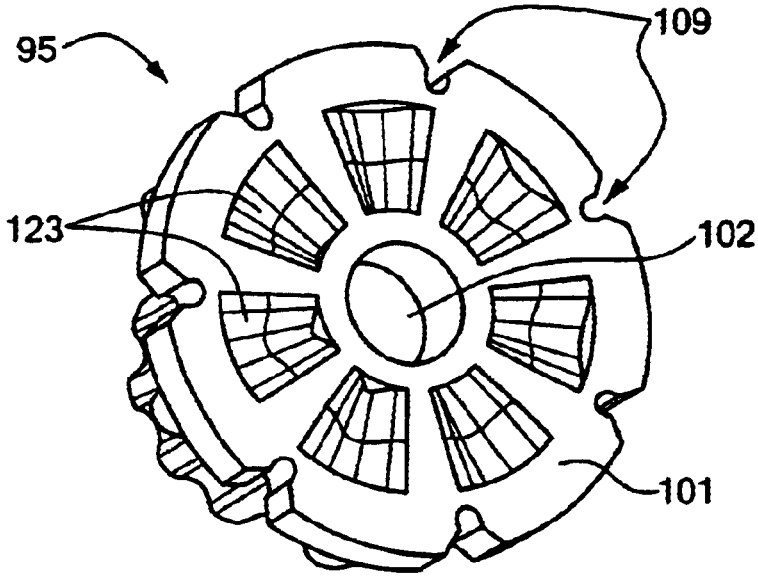
FIG. 11 is an enlarged, bottom perspective view of the indexing wheel shown in FIG. 1.
Figure 12:
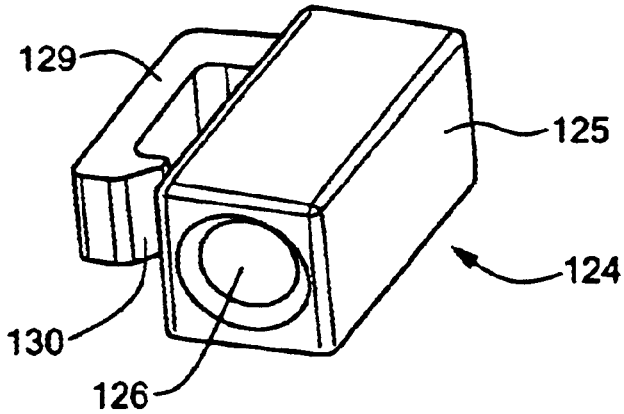
FIG. 12 is an enlarged, bottom perspective view of the detent shown in FIG. 1.

Referring now to FIGS. 9–11, ejection assembly 31 for dispensing fastener 15 comprises a needle 173, a needle lock 175, a rocker 177, a plunger 179, an ejector rod 181 and a nose insert 183.

Hollow slotted needle 173 is slidably disposed within a cylindrical needle receiving opening 174 formed in front 35 of housing 27. Hollow needle 173 includes a rear end 187 which is covered by a needle casing 189 and a forward end 191 in the form of a sharpened tip 193. Needle 173 includes an elongated bore 195 which is sized and shaped to receive the T-bar shaped second end 19 of a fastener 15. Needle 173 also includes a slot 197 in communication with bore 195, slot 197 being sized and shaped to enable a portion of the fastener filament 21 to slide therethrough.

Needle lock 175 is slidably mounted into front 35 of housing 27 and serves to lockably secure needle 173 within needle receiving opening 174 in housing 27. Specifically, rotation of needle lock 175 in one direction causes needle lock 175 to engage needle casing 189 so as to lockably secure needle 173 within housing 27. In addition, rotation of needle lock 175 in the opposite direction causes needle lock 175 to disengage needle casing 189, thereby enabling needle 173 to be removed from housing 27.

Figure 15:
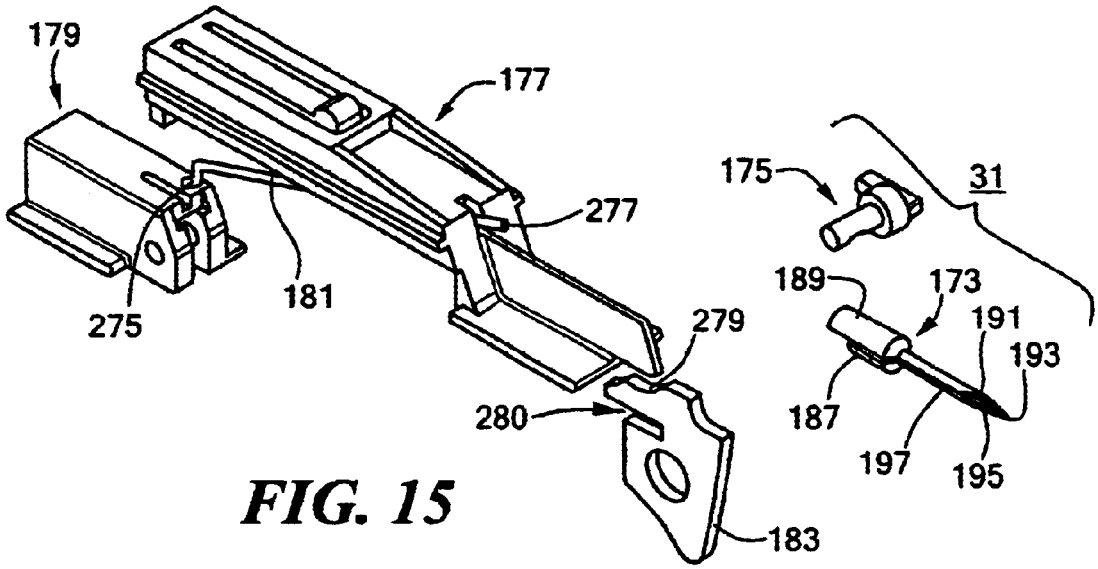
FIG. 15 is an exploded, perspective view of the ejection assembly shown in FIG. 1.
Figure 16:
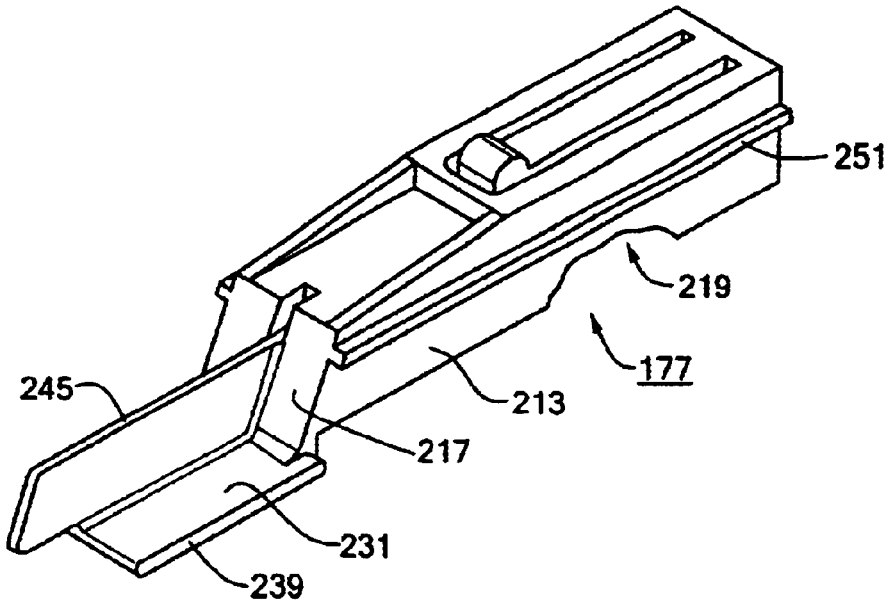
FIG. 16 is an enlarged, perspective view, broken away in part, of the rocket shown in FIG. 1.
Figure 17:
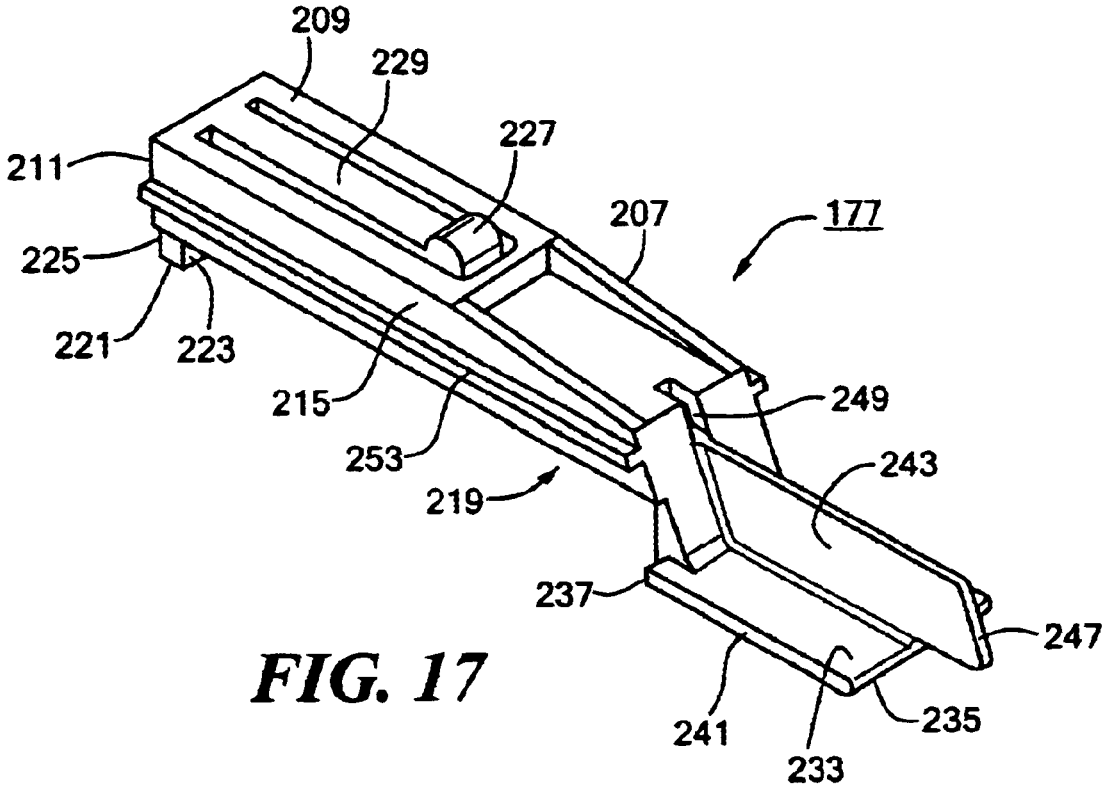
FIG. 17 is an enlarged, perspective view of the rocker shown in FIG. 1.

Referring now to FIGS. 15–17, rocker 177 comprises an elongated body 207 which includes a top wall 209, a rear wall 211, a left side wall 213, a right side wall 215, and an angled front wall 217. Elongated body 207 is hollowed out so as to form an elongated plunger receiving cavity 219 therein. A foot 221 having a front surface 223 and a rear surface 225 is integrally formed onto and extends down from rear wall 211.

A rocker stop, or pawl, 227 is formed into elongated body 207 and is pivotally connected to top wall 209 proximate rear wall 211 about a rocker stop arm 229. Rocker stop arm 229 is biased such that rocker stop 227 resiliently lies slightly above top wall 209. However, rocker stop arm 229 is capable of being pivoted downward such that rocker stop 227 lies flush with top wall 209.

A flat platform 231 is integrally formed onto angled front wall 217 and extends forward at an angle substantially in parallel with top wall 209. Platform 231 is generally rectangular and includes a top surface 233, a front edge 235, a rear edge 237, a left side edge 239, and a right side edge 241.

A blade 243 is integrally formed onto angled front wall 217 and top surface 209 of platform 231. Blade 243 includes a top edge 245 and a front edge 247 and extends forward from angled front wall 217 to a distance slightly in front of front edge 235 of platform 231.

An ejector rod slot 249 is formed in body 207 at the junction of top wall 209 and angled front wall 217, slot 249 being formed directly above blade 243. Ejector rod slot 249 is sized and shaped to enable ejector rod 181 to be disposed therethrough, as shown in FIG. 15.

Left sidewall 213 is shaped to include an outwardly projecting, elongated guide projection 251. Similarly, right sidewall 215 is shaped to include an outwardly projecting, elongated guide projection 253. As can be appreciated, with tagger gun 11 properly assembled, guide projection 251 is sized and shaped to project into an upper guide channel 252 formed in left side piece 47, guide projection 253 is sized and shaped to project into an upper guide channel 254 formed in right side piece 49, left edge 239 of platform 231 is sized and shaped to project into a lower guide channel 256 formed in left side piece 47 and right edge 241 of platform 231 is sized and shaped to project into a lower guide channel 257 formed in right side piece 49, thereby limiting rocker 177 to horizontal displacement within housing 29, which is highly desirable.

Figure 18:
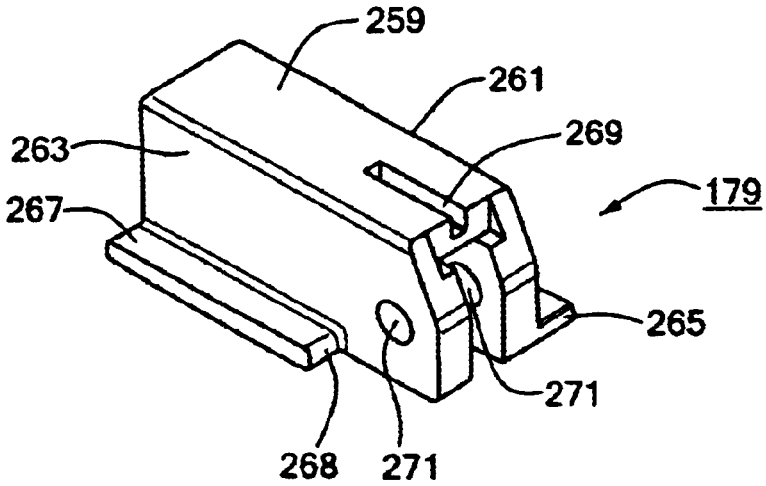
FIG. 18 is an enlarged, perspective view of the plunger shown in FIG. 1.
Figure 19B:
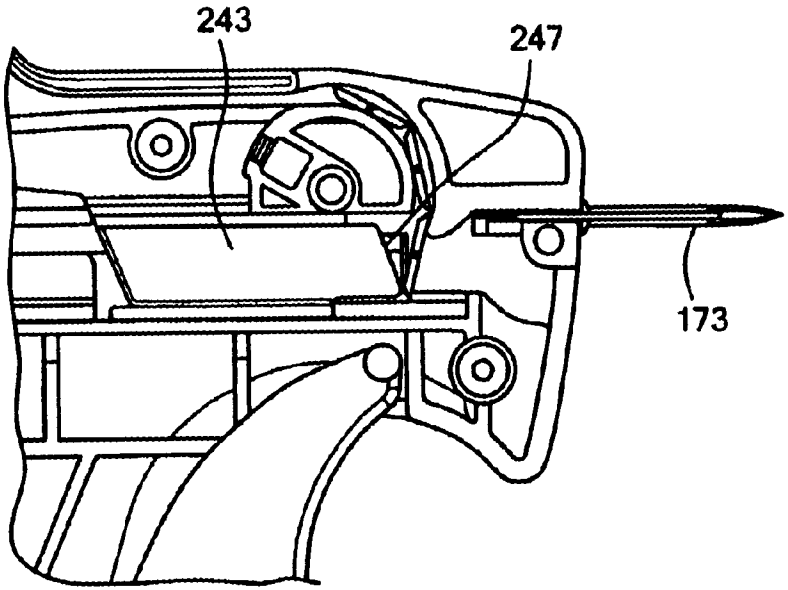
FIGS. 19(*a*)–(*f*) are fragmentary, right side views of the apparatus shown in FIG. 1 at various stages during the process for aligning an individual plastic fastener into the needle, the apparatus being shown with the indexing assembly, nose insert and right side piece of the housing removed.
Figure 19A:
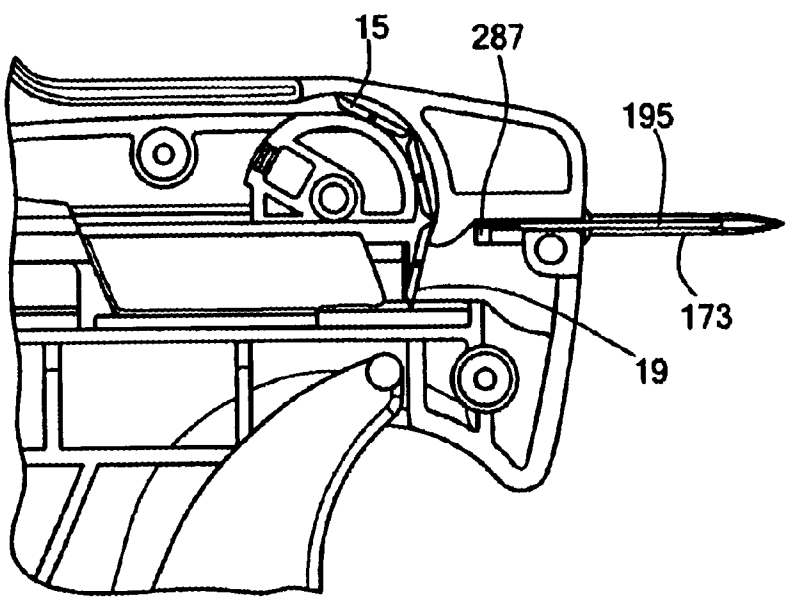
Figure 19D:
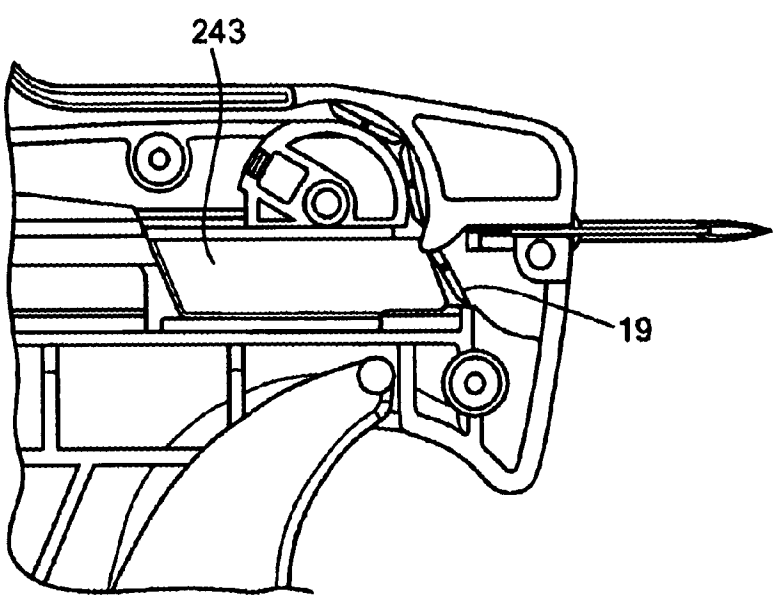
Figure 19C:
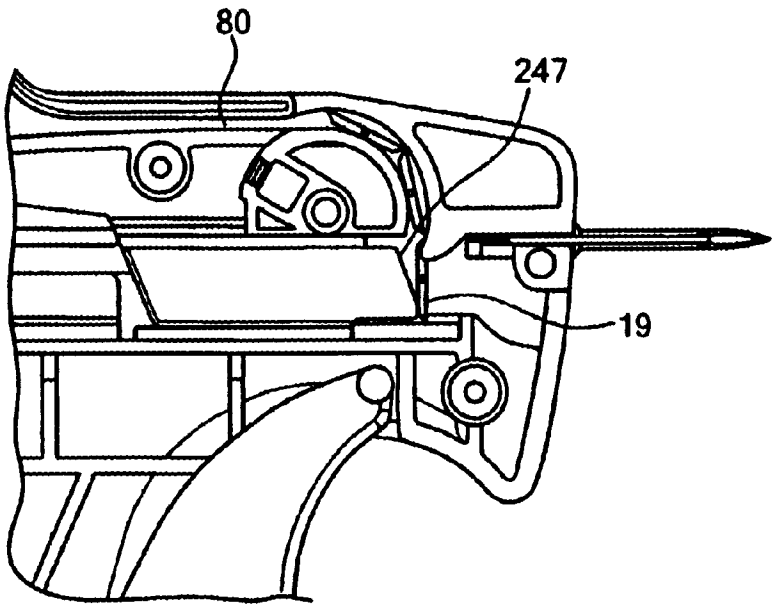
Figure 19F:
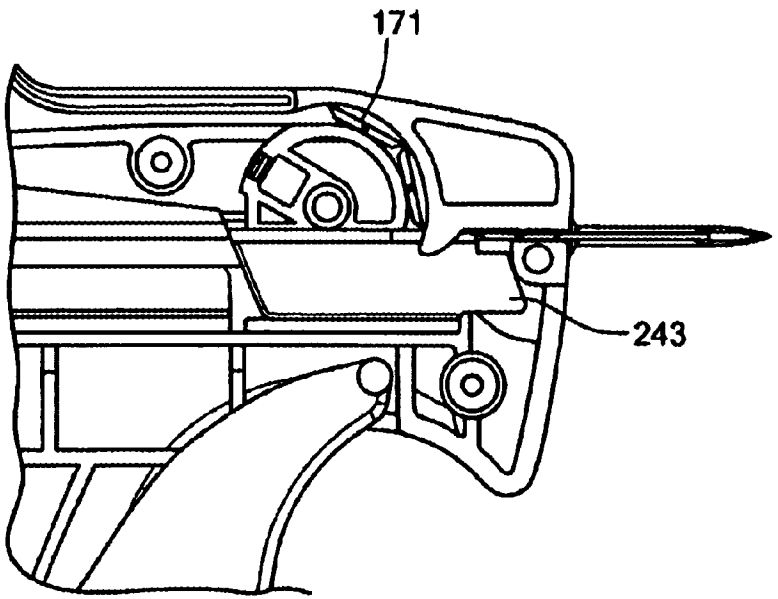
Figure 19E:
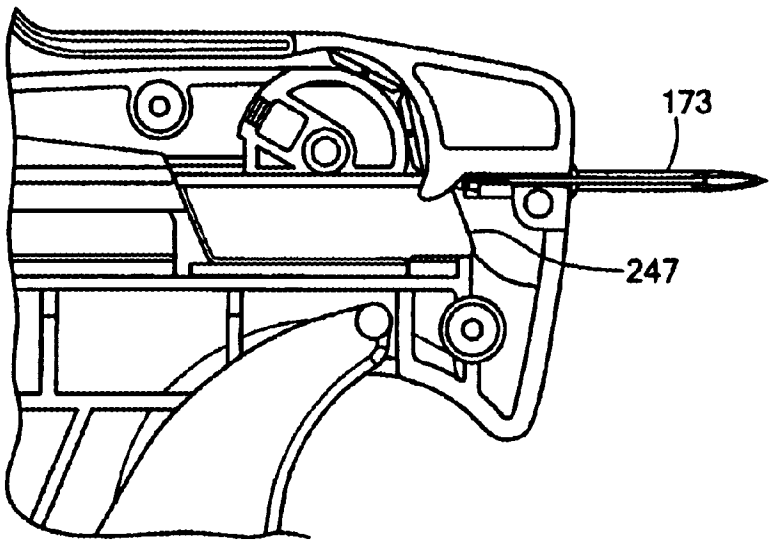

Referring now to FIGS. 15 and 18, plunger 179 has a generally U-shaped configuration and comprises a flat top wall 259 and a pair of spaced apart sidewalls 261 and 263 which extend down perpendicularly from top wall 259. As will be described further in detail below, plunger 179 is sized and shaped to be horizontally displaced within elongated plunger receiving cavity 219 in rocker 177.

Sidewall 261 is shaped to include an outwardly protruding flange 265. Similarly, sidewall 263 is shaped to include an outwardly protruding flange 267. As can be appreciated, with tagger gun 11 properly assembled, flange 265 is sized and shaped to project into lower guide channel 256 formed in left side piece 47 and flange 267 is sized and shaped to project into lower guide channel 257 formed in right side piece 49, thereby limiting plunger 179 to horizontal displacement within housing 27, which is highly desirable.

Top wall 259 of plunger 179 is shaped to include a shallow ejector rod slot 269 which is sized and shaped to receive ejector rod 181, as will be described further in detail below.

Each of sidewalls 261 and 263 include an opening 271. As will be described further in detail below, trigger assembly 33 is pivotally connected to plunger 179 about a dowel pin 273 which is sized and shaped to be fittingly disposed through openings 271. As such, dowel pin 273 serves as a pivot point about which trigger assembly 33 pivots relative to plunger 179.

Ejector rod 181 is an elongated cylindrical member which comprises a first end 275 and a second end 277. Ejector rod 181 is sized and shaped so that first end 275 can be releasably secured into an opening (not shown) formed in plunger 179 within ejector rod slot 269. With first end 275 mounted onto plunger 179, ejector rod 181 lies horizontally within slot 269. Second end 277 of ejector rod 181 extends horizontally forward from plunger 179, protrudes through slot 249 formed in rocker 177 and lies on top edge 245 of blade 243, thereby ensuring that ejector rod 181 is horizontally disposed, which is highly desirable.

Nose insert 183 is disposed between left side piece 47 and right side piece 49 of housing 27 and serves to guide the lowermost fastener 15 in the supply of fastener stock 13 into alignment with rear end 187 of needle 173 to be dispensed by ejection assembly 31. Specifically, nose insert 183 comprises a curved guide surface 279 which contacts filament 21 of the lowermost fastener 15 so as to guide the T-bar shaped second end 19 of the lowermost fastener 15 into rear end 187 of hollow needle 173. Nose insert 183 also includes a slot 280 which is sized and shaped to receive a portion of platform 231 of rocker 177.

It should be noted that nose insert 183 is shown as being a separate piece which secured to housing 27 by one of screws 51. However, it is to be understood that nose insert 183 could alternatively be integrally formed onto housing 27 without departing from the spirit of the present invention.

Referring now to FIGS. 19(*a*)–(*f*), ejection assembly 31 functions in the following manner. As shown in FIG. 19(*a*), indexing assembly 29 rotatably advances the lowermost fastener 15 from the supply of fastener stock 13 to a first position at rear end 187 of hollow needle 173 in which the T-bar shaped second end 19 is disposed at an angle relative to the longitudinal axis of bore 195. As shown sequentially in FIGS. 19(*b*)–(*e*), with the T-bar shaped second end 19 disposed as such, forward advancement of rocker 177 causes front edge 247 of blade 243 to push T-bar shaped second end 19 along guide surface 279 of nose insert 183, nose insert 183 being shown in FIG. 15. As shown in FIG. 19(*f*), continued forward displacement of rocker 177 eventually moves fastener 15 from the first position to a second position at rear end 187 of needle 173 in which the T-bar shaped second end 19 is disposed in parallel alignment with the longitudinal axis of bore 195. With the T-bar shaped second end 19 disposed at rear end 187 of hollow needle 173 in parallel with bore 195, ejector rod 181 horizontally displaces towards front 35 of housing 27, thereby urging the T-bar shaped second end 19 of fastener 15 through needle 173. Continued horizontal displacement of ejector rod 181 urges the T-bar shaped second end 19 through bore 195 and out sharpened tip 193 of hollow needle 173, thereby completing the ejection process.

It should be noted that, as second end 19 of fastener 15 is advanced from its first position to its second position, connector 25 which attaches the second end 19 of the desired fastener 15 to the remainder of fastener stock 13 is urged against a corner 283 integrally formed in left side piece 47. As second end 19 is further advanced forward, connector 25 severs, thereby separating fastener 15 from supply of fastener stock 13.

Figure 20:
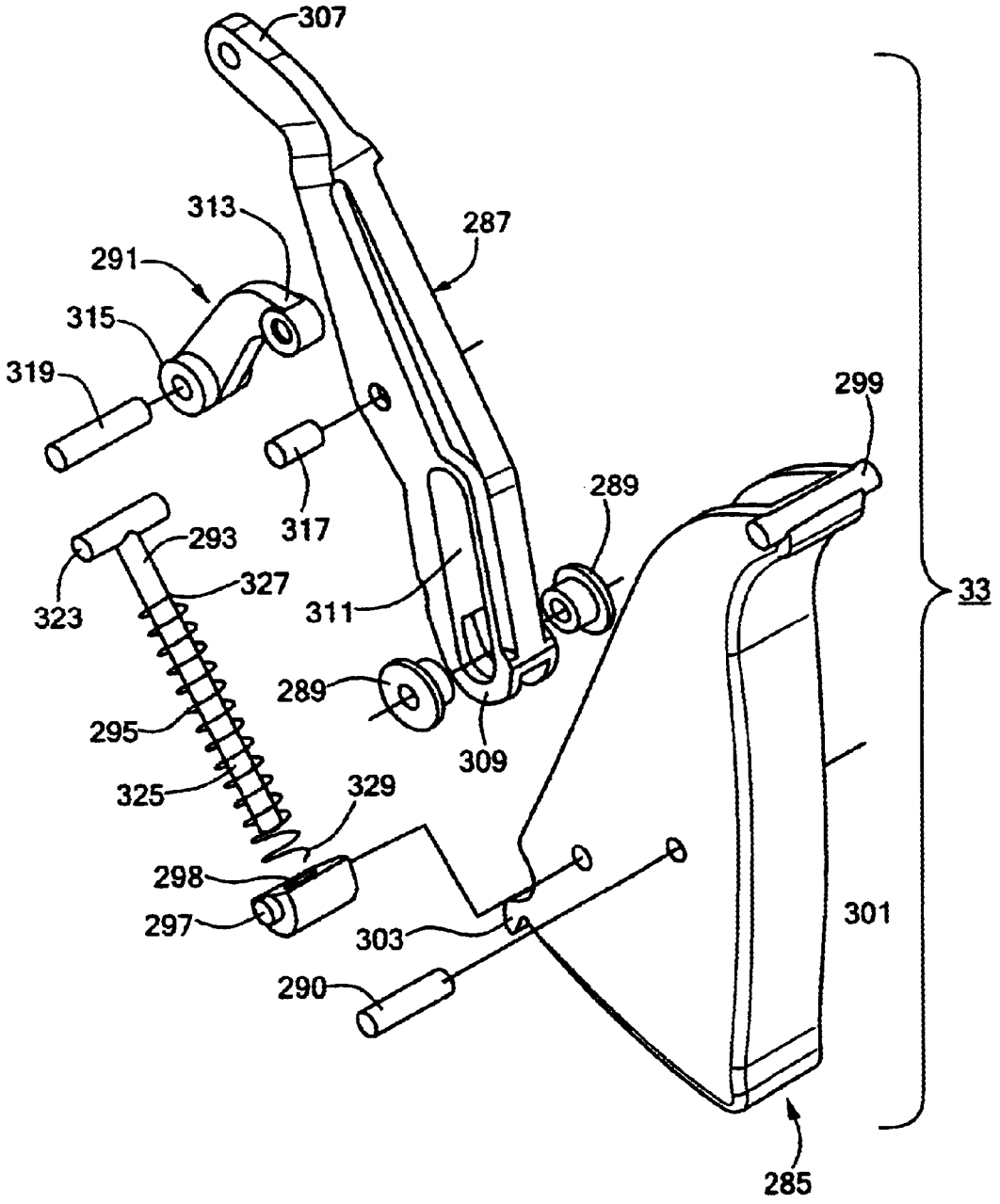
FIG. 20 is an enlarged perspective view of the trigger assembly shown in FIG. 1.
Figure 21A:
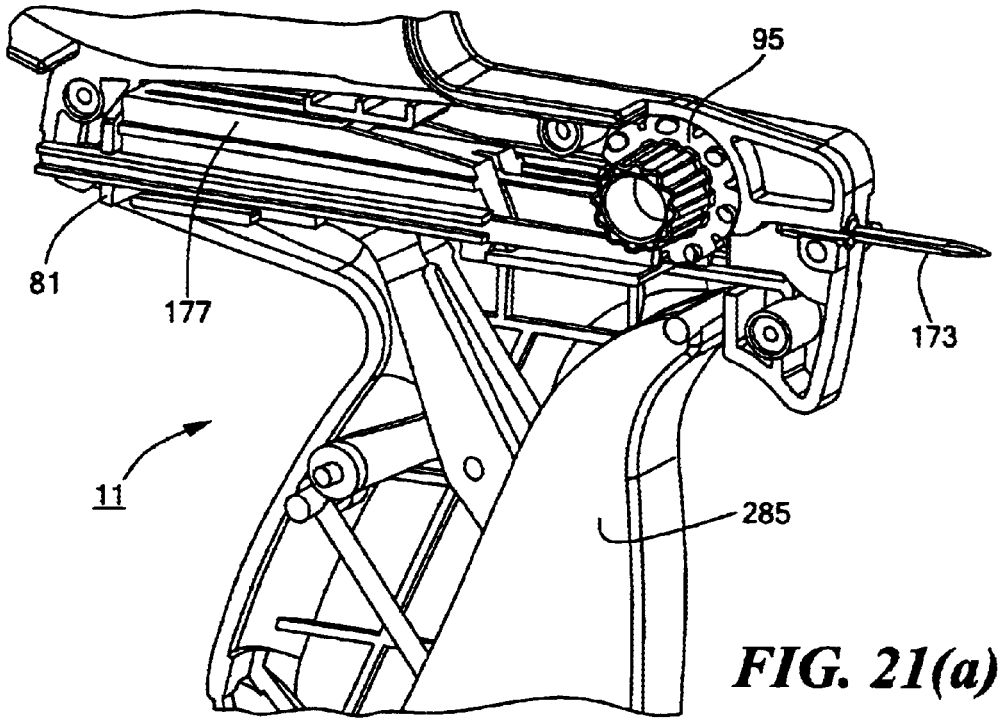
FIGS. 21(*a*)–(*i*) are fragmentary, right side views of the apparatus shown in FIG. 1 at various stages during the process for dispensing an individual plastic fastener from a supply fastener stock, the apparatus being shown with the right side piece of the housing and the trigger compression spring removed.
Figure 21B:
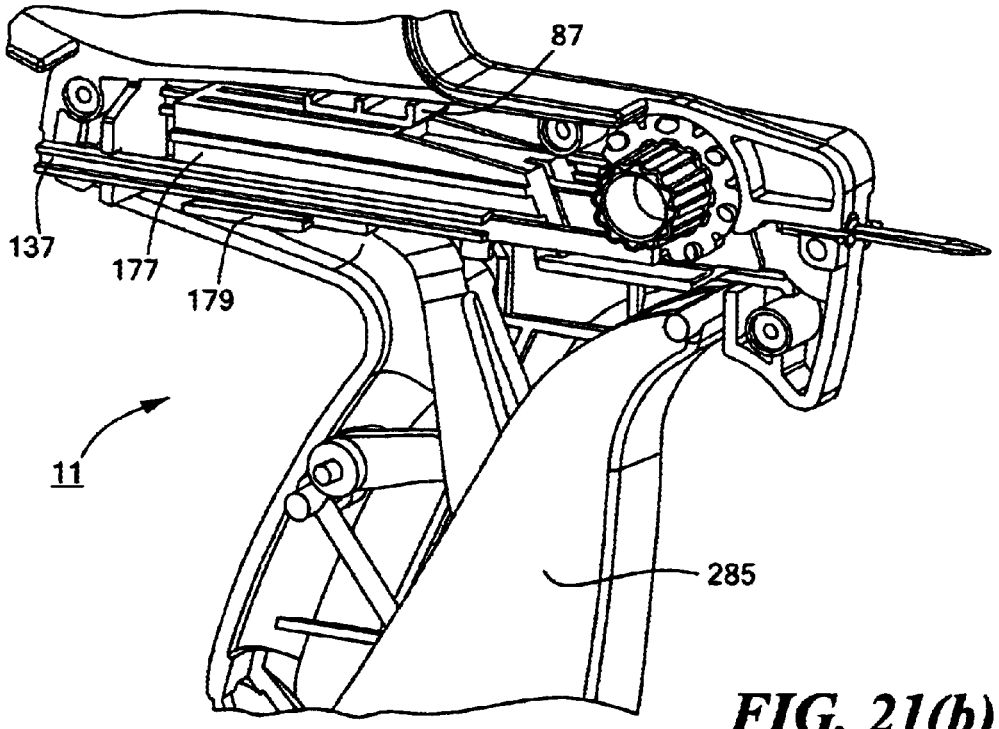
Figure 21C:
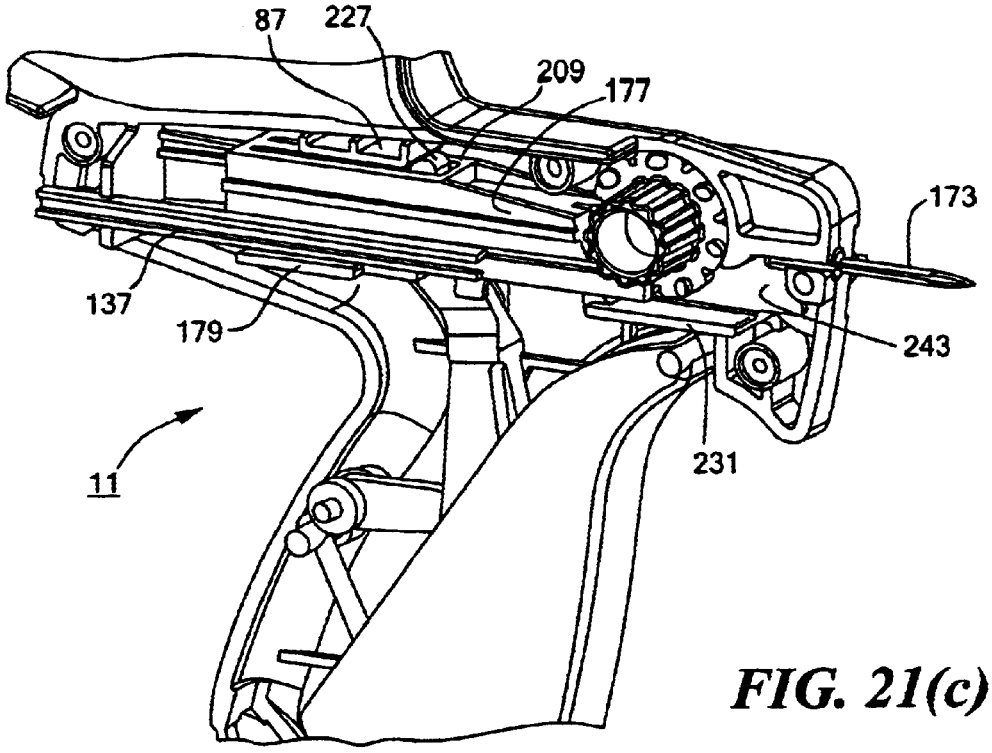
Figure 21D:
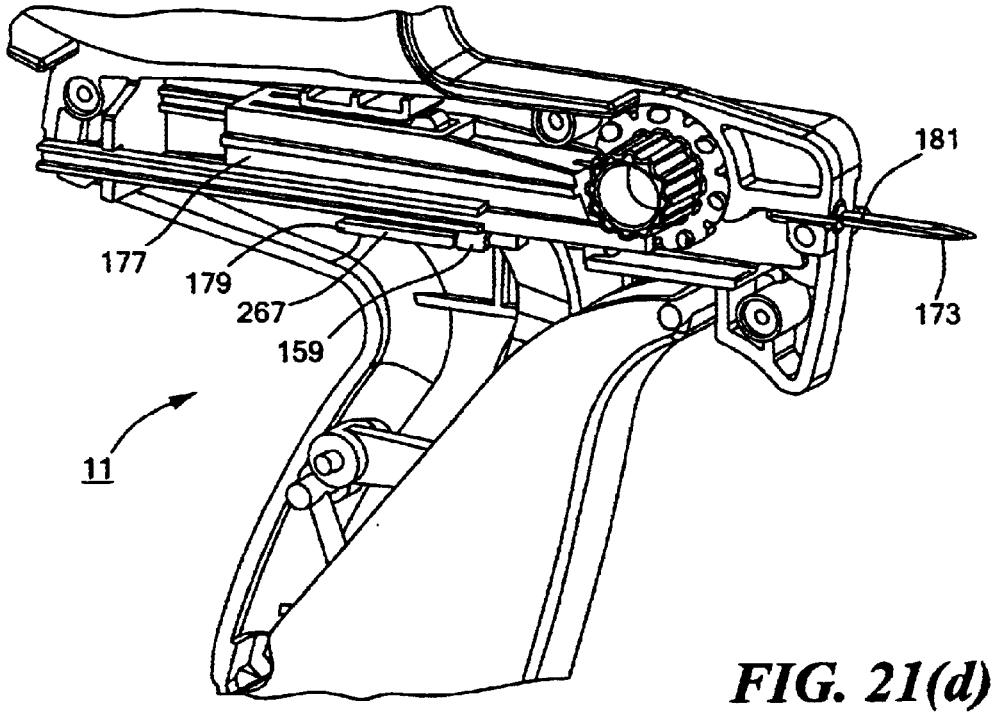
Figure 21E:
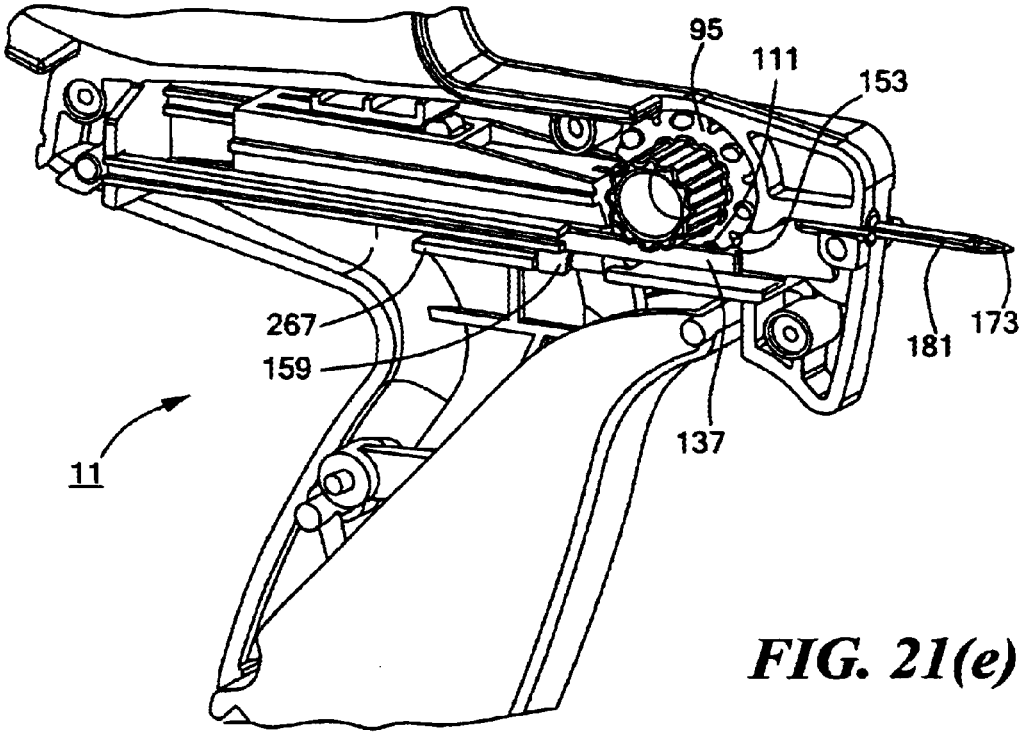
Figure 21F:
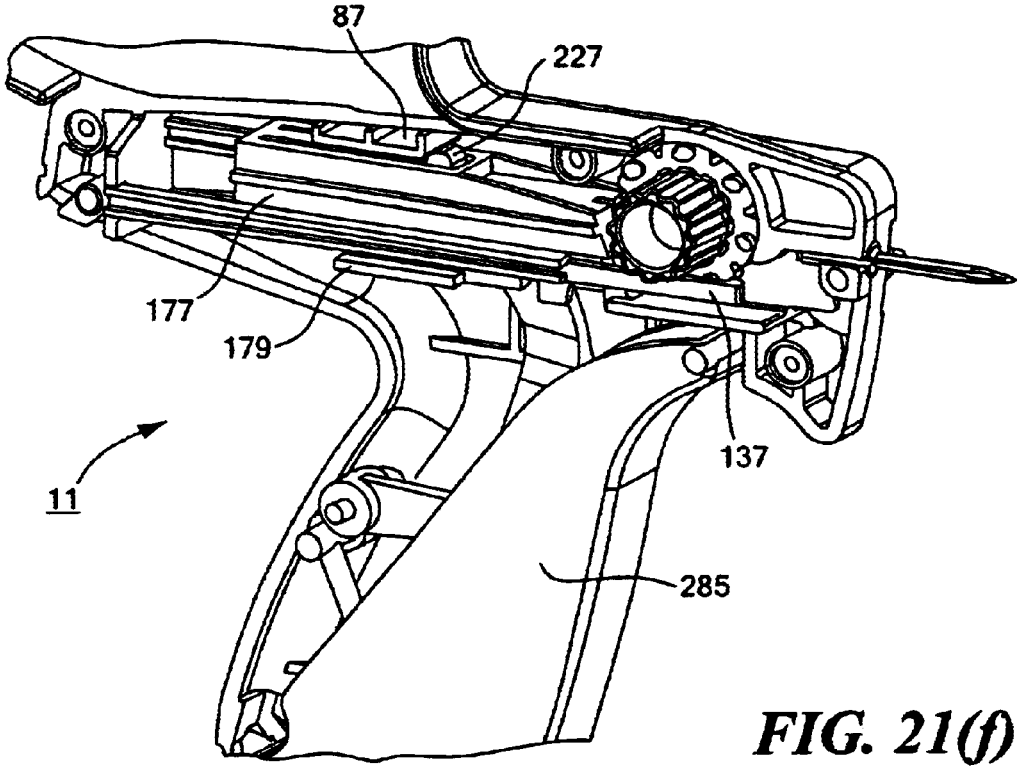
Figure 21G:
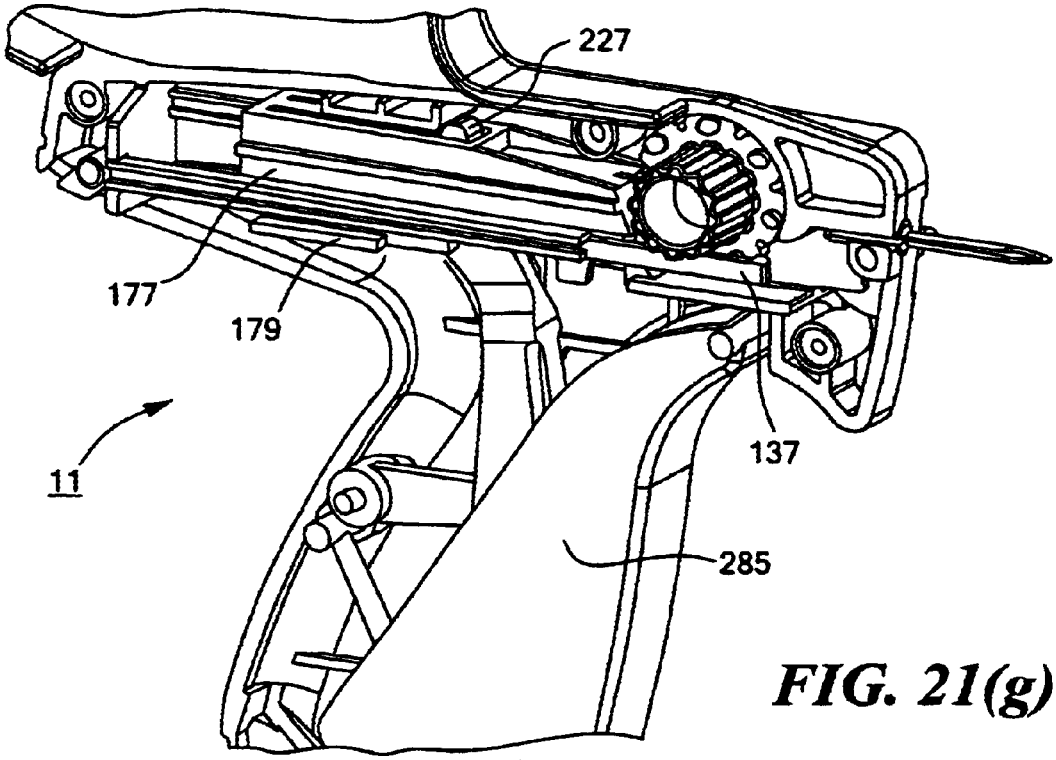
Figure 21H:
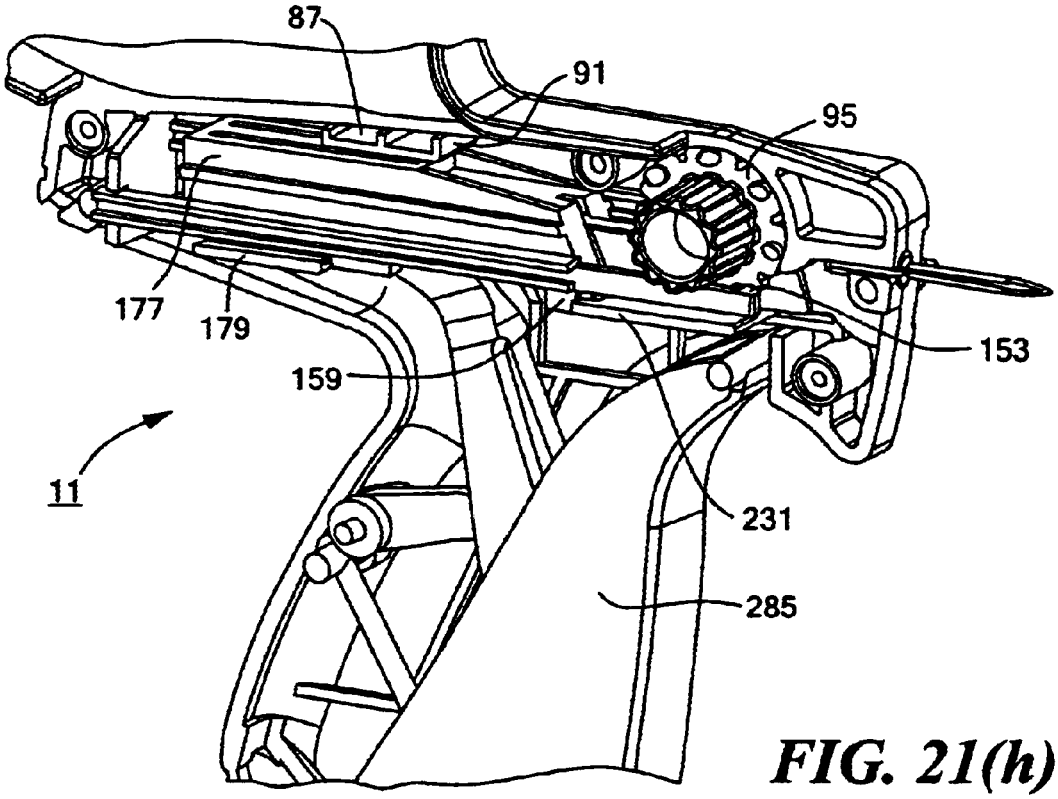
Figure 21I:
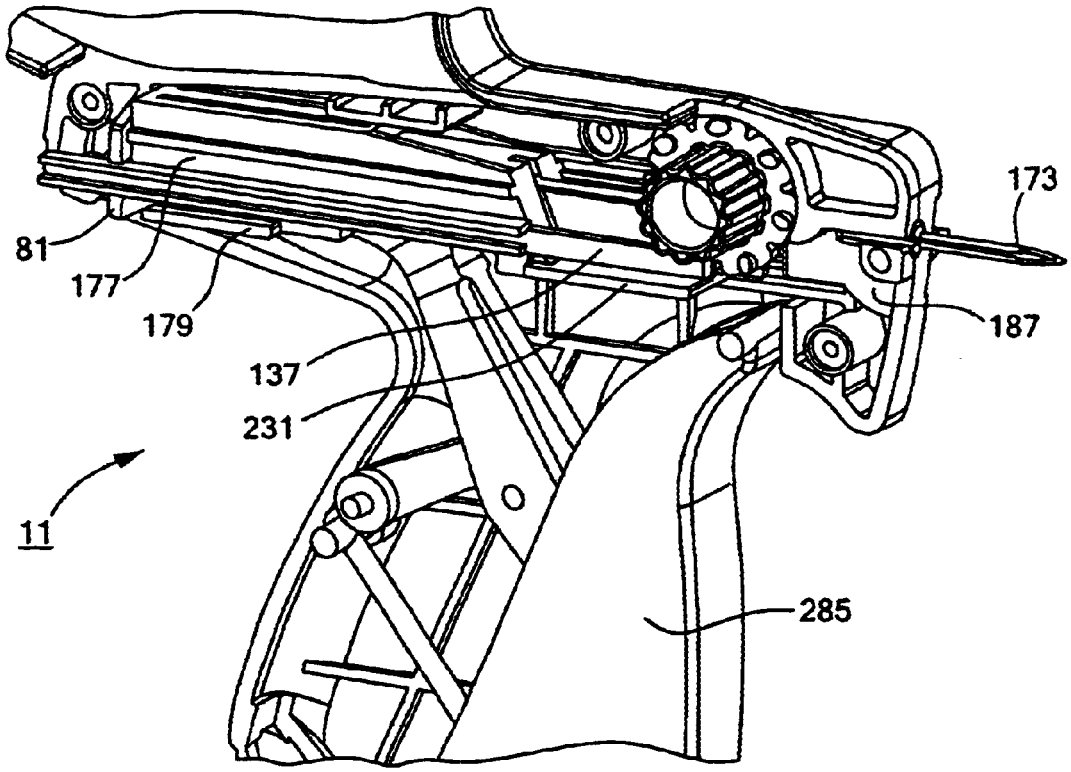

Referring now to FIG. 20, trigger assembly 33 activates ejection assembly 31 and indexing assembly 29 and is generally of the type described in U.S. Pat. No. 4,456,123 to Russell. Trigger assembly 33 comprises a trigger 285, a drive link 287, a pair of rollers 289, an idler link 291, a spring retainer 293, a compression spring 295 and a spring pivot 297.

Trigger 285 includes an integrally formed post 299, an elongated, ergonomically-shaped, finger actuation surface 301 and a foot 303. Post 299 is sized and shaped to be fittingly disposed within a trigger post receptacle 305 which is integrally formed in left handle piece 47 and within a trigger post receptacle 306 which is integrally formed in right handle piece 49. Actuation surface 301 is elongated and ergonomically-shaped to conform with the fingers of the user. Trigger 285 is hollowed so as to form a trigger cavity (not shown) therewithin.

Drive link 287 includes a first end 307, a second end 309 and an elongated slot 311 formed at second end 309. First end 307 of drive link 287 is pivotally mounted onto plunger 179 about dowel pin 273 which is disposed through openings 271 in sidewalls 261 and 263. Pair of rollers 289 are fixedly mounted onto trigger 285 within the trigger cavity about a dowel pin 290 and are disposed so as to project within slot 311 formed in drive link 287. Accordingly, rollers 289 are capable of travelling within slot 311 in drive link 287.

Idler link 291 is an L-shaped member which includes a first end 313 and a second end 315. First end 313 is fixedly mounted onto the approximate midpoint of drive link 287 about a dowel pin 317. In addition, a dowel pin 319 is fixedly mounted onto second end 315 of idler link 291 and is sized and shaped to be fittingly disposed within a idler link receptacle 321 formed into housing 27, thereby enabling drive link 287 to pivot about dowel pin 319.

Spring retainer 293 is a generally T-shaped member which includes a first end 323 in the shape of a post and a second end 325. Compression spring 295 includes a first end 327 and a second end 329 and is sized and shaped to be slidably mounted onto second end 325 of spring retainer 293. Spring pivot 297 is pivotally mounted onto trigger 285 and is disposed within the trigger cavity. As such, spring retainer 293 is disposed such that first end 323 is fittingly disposed within a spring retainer receptacle 324 formed in housing 27 and second end 325 is disposed through a circular opening 298 formed in spring pivot 297. With spring retainer 293 positioned in this manner, first end 327 of compression spring 295 contacts first end 323 of spring retainer 293 and second end 329 of compression spring 295 contacts spring pivot 297, thereby causing compression spring 295 to resiliently urge trigger 285 outward until foot 303 on trigger 285 abuts against trigger stop 93 formed into housing 27.

As will be described further below, trigger assembly 33 functions in the following manner. Specifically, trigger 285 is resiliently urged by trigger compression spring 295 outward until foot 303 on trigger 285 abuts against trigger stop 93. Upon the application of an inward force onto actuation surface 301, trigger 285 pivots about post 299 which, in turn, causes rollers 289 to apply an inward force onto drive link 287 as rollers 289 slide upward within slot 311. The inward force applied to second end 309 of drive link 287 causes drive link 287 to pivot in a clockwise direction about dowel pin 319. Upon release of the inward force, trigger compression spring 295 resiliently urges trigger 285 outward until foot 303 on trigger 285 abuts trigger stop 93, thereby returning trigger assembly 33 to its original position.

In use, tagger gun 11 functions in the following manner to dispense individual plastic fasteners 15 from supply of fastener stock 13. With supply of fastener stock 13 mounted onto attachment 53, the free end of fastener stock 13 is fed through fastener track 80 until filament 21 of the lowermost fastener 15 is aligned within a notch 109 in indexing wheel 95. At this point, the user manually rotates indexing wheel 95 in the clockwise direction using handle 119 until the lowermost fastener 15 is advanced to a position at rear end 187 of needle 173 in which second end 19 of fastener 15 is disposed at an angle relative to the longitudinal axis of needle bore 195. With supply of fastener stock 13 properly loaded onto tagger gun 11 in this manner, tagger gun 11 is disposed in its initial position, as shown in FIG. 21(*a*). With tagger gun 11 disposed in its initial position, trigger 285 is outwardly biased by trigger compression spring 295 such that trigger foot 303 abuts against trigger stop 93 and rear wall 211 of rocker 177 abuts against rear rocker stop 81.

The forward stroke of tagger gun 11 commences upon the activation of trigger 285. Specifically, trigger 285 is inwardly urged, or compressed, thereby causing plunger 179 to advance forward. It should be noted that bottom surface 89 of intermediate rocker stop 87 serves to downwardly pivot rocker stop 227, thereby temporarily locking together rocker 177 with plunger 179. As a result, the forward advancement of plunger 179, in turn, causes the forward advancement of rocker 177. However, although rocker 177 and plunger 179 together advance forward, indexing slide 137 remains stationary. Accordingly, rocker 177 and plunger 179 advance horizontally forward, as shown in FIG. 21(*b*).

Continuation of the forward stroke of tagger gun 11 serves to align second end 19 of the lowermost fastener 15 into alignment within bore 195 of hollow needle 173. Specifically, with slide 137 stationary, rocker 177 and plunger 179 continue to advance forward. Upon forward displacement of rocker 177, front edge 247 of blade 243 contacts the lowermost fastener 15, thereby urging the fastener 15 forward. As rocker 177 urges the lowermost fastener 15 forward, filament 21 of the lowermost fastener 15 contacts curved guide surface 279 of nose insert 183, thereby pivoting the T-bar shaped second end 19 of the lowermost fastener 15 to a position at rear end 187 of needle 173 in which second end 19 is disposed into parallel alignment with bore 195 of hollow needle 173. Rocker 177 continues forward such that front edge 235 of rocker platform 231 projects into slot 280 of nose insert 183. It should be noted that, once rocker 177 is positioned such that rocker pawl 227 is disposed in front of front edge 91 of intermediate rocker stop 87, rocker pawl 227 biases up above top wall 209 of rocker 177, as shown in FIG. 21(*c*), thereby disengaging, or unlocking, rocker 177 from plunger 179. As a result, rocker 177 remains stationary upon further forward displacement of plunger 179.

Continuation of the forward stroke of tagger gun 11 serves to begin the ejection of second end 19 of the lowermost fastener 15 from needle 173. Specifically, with rocker 177 and slide 137 stationary, plunger 179 continues to advance forward within the plunger receiving cavity 219 in rocker 177. Continued forward advancement of plunger 179 causes ejector rod 181 to protrude into hollow needle 173. As ejector rod 181 extends into hollow needle 173, ejector rod 181 contacts the T-bar shaped second end 19 of the lowermost fastener 15 and urges second end 19 out through hollow needle 173. Plunger 179 continues forward until front edge 268 of plunger flange 267 abuts against rear edge 163 of slide tab 159, as shown in FIG. 21(*d*). It should be noted that ejector rod 181 extends approximately half-way down hollow needle 173 once plunger flange 267 abuts against slide tab 159.

Completion of the forward trigger stroke of tagger gun 11 serves to complete the fastener ejection process. Specifically, with front edge 268 of plunger flange 267 abutting against rear edge 163 of slide tab 137, the final forward advancement of plunger 179 causes ejector rod 181 to extend through needle 173 to forward end 191, thereby enabling ejector rod 181 to urge second end 19 of the lowermost fastener 15 from hollow needle 173. In addition, the final forward advancement of plunger 179 urges tooth 153 of indexing slide 137 over and in front of the lowermost pin 111 on indexing wheel 95, as shown in FIG. 21(*e*). It should be noted that completion of the forward stroke of tagger gun 11 causes trigger 285 to pivot inward to its maximum compressed position.

After ejection of the lowermost fastener 15, the rearward stroke of tagger gun 11 commences. Specifically, the user releases trigger 285, thereby enabling trigger compression spring 295 to outwardly urge trigger 285. As trigger 285 moves outward, plunger 179 commences movement in the backward direction. It should be noted that, as plunger 179 commences movement in the backward direction, rocker pawl 227 abuts against front edge 91 of intermediate rocker stop 87, thereby precluding rearward movement of rocker 177. As a result, plunger 179 continues movement backward within plunger receiving cavity 219 without rocker 177 and indexing slide 137, as shown in FIG. 21(*f*).

Continued release of trigger 285 causes plunger 179 to continue in the backward direction without rocker 177 and indexing slide 137. Plunger 179 continues backward until the rear edge of sidewalls 261 and 263 of plunger 179 abut against the inner surface of rear wall 211 of rocker 177, as shown in FIG. 21(*g*). It should be noted that indexing slide 137 remains in front of lowermost pin 111 on indexing wheel 95.

Continued release of trigger 285 causes plunger 179 to continue in the backward direction. Accordingly, with the rear edge of sidewalls 261 and 263 of plunger 179 abutting against the inner surface of rear wall 211 of rocker 177, the rearward displacement of plunger 179 creates enough force to pull rocker 177 backward, rocker pawl 227 pivoting downward as rocker 177 moves backward. As can be appreciated, the downward deflection of rocker pawl 227 due to its contact against bottom surface 89 of intermediate rocker stop 87 serves to, once again, temporarily couple, or lock, together plunger 179 and rocker 177. Accordingly, plunger 179 and rocker 177 together move in the backward direction until rear edge 237 of rocker platform 231 abuts against forward edge 161 of slide tab 159. With rear edge 237 of rocker platform 231 abutting against forward edge 161 of slide tab 159, continued rearward displacement of rocker 177 and plunger 179, in turn, pulls indexing slide 137 backwards. As indexing slide 137 is pulled backwards, slide tooth 153 engages engagement surface 117 of the lowermost pin 111 on indexing wheel 95, as shown in FIG. 21(*h*).

Continued release of trigger 285 completes the rearward stroke for tagger gun 11. Specifically, continued release of trigger 285 causes plunger 179 and rocker to move backwards which, in turn, pulls slide 137 backwards. The rearward displacement of indexing slide 137 causes indexing slide 137 to rotate indexing wheel 95 one position in the clockwise direction. Clockwise rotation of indexing wheel 95 rotatably advances the next individual fastener 15 from the supply of fastener stock 13 down to a position at rear end 187 of needle 173 wherein second end 19 of the fastener 15 is disposed at an angle relative to the longitudinal axis of bore 195, thereby enabling for additional fastener dispensing. It should be noted that, because the indexing process occurs during the rearward stroke of tagger gun 11, indexing slide 137 is pulled backwards entirely by the force provided from compression spring 295, thereby limiting the manual trigger activation force required by the operator, which is highly desirable.

Plunger 179 and rocker 177 continue displacement rearward until rear wall 211 of rocker 177 abuts against rocker stop 81, as shown in FIG. 21(*i*). As such, the rearward stroke is completed and tagger gun 11 is disposed at its original position. As can be appreciated, the aforementioned process can be repeated numerous times accordingly to continuously dispense individual plastic fasteners 15 from supply of fastener stock 13.

It should be noted that tagger gun 11 comprises a relatively small number of components in comparison to prior art tagger guns. In particular, tagger gun 11 utilizes only two compression springs. As a result, it has been found that tagger gun 11 is relatively simple and inexpensive to manufacture, which is highly desirable.

It should also be noted that tagger gun 11 utilizes a relatively simple ejection and indexing process in comparison to prior art tagger guns. As a result, it has been found that tagger gun 11 has a relatively smooth forward stroke and requires a low trigger activation force, thereby simplifying its usage, which is highly desirable.

It should further be noted that tagger gun 11 only indexes the next fastener 15 in fastener stock 13 to a position at rear end 187 of needle 173 upon completion of the forward stroke of the ejection of the prior fastener. As a result, it has been found that tagger gun 11 is less susceptible to jamming than prior art tagger guns, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An apparatus for dispensing individual plastic fasteners from fastener stock, each fastener comprising a flexible filament and a transversely disposed cross-bar at one end, cross-bars of adjacent fasteners being joined end-to-end by severable connectors, said apparatus comprising:

(a) a housing, (b) a needle mounted onto said housing, said needle comprising a front end, a rear end and a longitudinal bore, (c) an indexing wheel rotatably disposed within said housing, said indexing wheel rotatably advancing a fastener from the fastener stock to a first position at the rear end of said needle in which the cross-bar of the fastener is disposed at an angle relative to the bore, (d) a rocker disposed within said housing for moving the cross-bar of the fastener from the first position to a second position at the rear end of said needle in which the cross-bar of the fastener is disposed in parallel with the bore, (e) an ejector rod disposed within said housing for pushing the cross-bar of the fastener from the second position, through the bore and out the front end of said needle, and (f) an indexing slide disposed within said housing for rotatably advancing said indexing wheel, said indexing slide being separate from said rocker.

2. The apparatus of claim 1 wherein said indexing slide is slidably disposed within said housing and comprises a tab and a tooth, said tooth being sized and shaped to selectively engage said indexing wheel.

3. The apparatus of claim 1 further comprising a plunger which is slidably disposed within said housing.

4. The apparatus of claim 3 wherein said plunger is coupled to a trigger assembly.

5. The apparatus of claim 3 wherein said ejection rod is fixedly mounted onto said plunger.

6. The apparatus of claim 5 wherein said rocker is slidably disposed within said housing and comprises an elongated body.

7. The apparatus of claim 6 wherein said rocker comprises a blade which extends out from the elongated body.

8. The apparatus of claim 7 wherein said rocker comprises a pawl which is pivotally mounted onto the elongated body.

9. The apparatus of claim 8 wherein said rocker comprises a flat platform which extends out from the elongated body.

10. The apparatus of claim 6 wherein said plunger is slidably disposed within the elongated body of said rocker.

11. The apparatus of claim 10 wherein said plunger comprises a flat top wall and a pair of spaced apart sidewalls which extend down perpendicularly from the top wall, said top wall being shaped to include an ejector rod slot which is sized and shaped to receive a portion of said ejector rod.

12. The apparatus of claim 1 wherein said housing includes a cut-out portion which is sized and shaped to expose the majority of said indexing wheel.

13. The apparatus of claim 1 wherein said indexing wheel comprises a top surface, a bottom surface and a plurality of index pins formed onto the top surface.

14. The apparatus of claim 13 wherein a handle for manually rotating said indexing wheel is formed onto the top surface of said indexing wheel.

15. The apparatus of claim 13 wherein the bottom surface of said indexing wheel is shaped to include a plurality of grooves.

16. The apparatus of claim 15 further comprising a spring biased detent which is sized and shaped to selectively engage the plurality of grooves formed on said indexing wheel.

17. The apparatus of claim 16 wherein said detent is releasably snap-fit into a detent receptacle formed in said housing, said detent comprising a pivotable catch arm for retaining said detent within the detent receptacle.

18. The apparatus of claim 1 wherein said housing is shaped to include a fastener track through which the cross-bar of each fastener in the supply of fastener stock passes, the fastener track being sized and shaped to retain the cross-bar of each fastener in the supply of fastener stock within said housing.

19. An apparatus for dispensing individual plastic fasteners from fastener stock, each fastener comprising a flexible filament and a transversely disposed cross-bar at one end, cross-bars of adjacent fasteners being joined end-to-end by severable connectors, said apparatus comprising:

(a) a housing, (b) a needle mounted onto said housing, said needle comprising a front end, a rear end and a longitudinal bore, (c) an indexing wheel rotatably disposed within said housing, said indexing wheel rotatably advancing a fastener from the fastener stock to a first position at the rear end of said needle in which the cross-bar of the fastener is disposed at an angle relative to the bore, said indexing wheel comprising a top surface, a bottom surface, a plurality of index pins formed onto the top surface and a handle formed onto the top surface, the bottom surface being shaped to include a plurality of grooves, (d) a detent disposed into said housing, said detent comprising a tip which is sized and shaped to selectively engage the plurality of grooves formed in said indexing wheel, (e) a rocker disposed within said housing for moving the cross-bar of the fastener from the first position to a second position at the rear end of said needle in which the cross-bar of the fastener is disposed in parallel with the bore, (f) an ejector rod disposed within said housing for pushing the cross-bar of the fastener from the second position, through the bore and out the front end of said needle, and (g) an indexing slide disposed within said housing for rotatably advancing said indexing wheel.

20. The apparatus of claim 19 wherein said detent is releasably snap-fit into said housing, said detent comprising a pivotable catch arm for retaining said detent within said housing.

21. The apparatus of claim 19 wherein said housing includes a cut-out portion which is sized and shaped to expose the majority of said indexing wheel.

22. A method of dispensing individual plastic fasteners through a needle, said needle comprising a front end, a rear end and a longitudinal bore, wherein each fastener includes a filament with an angularly disposed cross-bar at one end of the filament, said method comprising the steps of:

(a) advancing a first fastener from the fastener stock to a first position at the rear end of the needle in which the cross-bar of the first fastener is disposed at an angle relative to the bore, (b) moving the cross-bar of the first fastener from the first position to a second position at the rear end of the needle in which the cross-bar of the first fastener is disposed in parallel with the bore, (c) pushing the cross-bar of the first fastener from the second position, through the bore and out the front end of the needle, and (d) after said pushing step, advancing a second fastener from the fastener stock to a first position at the rear end of the needle in which the cross-bar of the second fastener is disposed at an angle relative to the bore.

* * * * *